US009008555B2

(12) United States Patent
Eto

(10) Patent No.: US 9,008,555 B2
(45) Date of Patent: Apr. 14, 2015

(54) IMAGE FORMING APPARATUS INCLUDING TONER CASE, DRIVING MECHANISM, AND INSTALLED PART AND TONER CASE THEREFOR

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 152 days.

(21) Appl. No.: 13/754,381

(22) Filed: Jan. 30, 2013

(65) Prior Publication Data

US 2013/0195510 A1 Aug. 1, 2013

(30) Foreign Application Priority Data

Jan. 31, 2012 (JP) ..... 2012-019168

(51) Int. Cl.
*G03G 15/08* (2006.01)
*G03G 21/16* (2006.01)

(52) U.S. Cl.
CPC ..... *G03G 15/0896* (2013.01); *G03G 21/1647* (2013.01); *G03G 21/1676* (2013.01)

(58) Field of Classification Search
CPC ..... G03G 15/0896
USPC ..... 399/258, 119, 260, 262, 263
See application file for complete search history.

(56) References Cited

U.S. PATENT DOCUMENTS

| | | | | |
|---|---|---|---|---|
| 7,369,798 | B2 * | 5/2008 | Sasae et al. | 399/262 |
| 7,738,817 | B2 * | 6/2010 | Sasae et al. | 399/258 |
| 8,285,179 | B2 | 10/2012 | Kimura et al. | |
| 2004/0131391 | A1 * | 7/2004 | Nagashiro | 399/258 |

(Continued)

FOREIGN PATENT DOCUMENTS

| | | | |
|---|---|---|---|
| CN | 1722021 | A | 1/2006 |
| CN | 101226363 | A | 7/2008 |

(Continued)

OTHER PUBLICATIONS

Japanese Office Action "Notification of Reasons for Rejection" dated Jun. 18, 2013, which corresponds to Japanese Patent Application No. 2012-019168 and is related to U.S. Appl. No. 13/754,381.

(Continued)

*Primary Examiner* — Susan Lee
(74) *Attorney, Agent, or Firm* — Studebaker & Brackett PC

(57) ABSTRACT

An image forming apparatus includes a toner case, a driving mechanism and an installed part. The toner case includes a container main body, a rotating member and a transmission coupling. The container main body is provided with a discharge port configured to discharge a toner. The rotating member is installed into the container main body. The transmission coupling is connected with the rotating member. The driving mechanism includes a drive coupling and a drive unit. The drive coupling is detachably connected with the transmission coupling. The toner case has a lever supported onto the container main body. The driving mechanism has a movement mechanism which works in accordance with the operation of the lever, in a state of installing the toner case into the installed part, to move the drive coupling from a disconnecting position to a connecting position with the transmission coupling.

18 Claims, 20 Drawing Sheets

(56) References Cited

U.S. PATENT DOCUMENTS

| | | | | |
|---|---|---|---|---|
| 2006/0013621 | A1 | 1/2006 | Kimura et al. | |
| 2008/0025764 | A1 | 1/2008 | Kimura et al. | |
| 2008/0038023 | A1 | 2/2008 | Eto | |
| 2008/0170889 | A1 | 7/2008 | Eto et al. | |
| 2009/0129813 | A1* | 5/2009 | Nagashima et al. | 399/119 |
| 2009/0232546 | A1 | 9/2009 | Yamada et al. | |
| 2009/0290911 | A1 | 11/2009 | Kimura et al. | |
| 2011/0052269 | A1 | 3/2011 | Kimura et al. | |
| 2011/0222915 | A1* | 9/2011 | Furuhata | 399/262 |
| 2012/0076550 | A1 | 3/2012 | Kimura et al. | |
| 2013/0259535 | A1 | 10/2013 | Kimura et al. | |
| 2014/0227009 | A1 | 8/2014 | Kimura et al. | |

FOREIGN PATENT DOCUMENTS

| | | | |
|---|---|---|---|
| EP | 1617296 | A2 | 1/2006 |
| JP | 2008-040377 | A | 2/2008 |
| JP | 2009-222767 | A | 10/2009 |

OTHER PUBLICATIONS

The extended European search report issued on Jul. 25, 2013, which corresponds to EP13152185.8 and is related to U.S. Appl. No. 13/754,381.

The first Office Action issued by the Chinese Patent Office on Jul. 29, 2014, which corresponds to Chinese Patent Application No. 201310029496.0 and is related to U.S. Appl. No. 13/754,381.

* cited by examiner

IMAGE FORMING APPARATUS INCLUDING TONER CASE, DRIVING MECHANISM, AND INSTALLED PART AND TONER CASE THEREFOR

INCORPORATION BY REFERENCE

This application is based on and claims the benefit of priority from Japanese Patent application No. 2012-019168 filed on Jan. 31, 2012, the entire contents of which are incorporated herein by reference.

BACKGROUND

The present disclosure relates to an image forming apparatus and a toner case installed therein.

An electrographic image forming apparatus has performed a developing process by supplying a toner (a developer) from a development device to an electrostatic latent image formed on a surface of a photosensitive drum or the like. The toner used in such a developing process is supplied from a toner case, such as a toner container or an intermediate hopper, to the development device.

The above-mentioned toner case includes rotating members, such as a stirring paddle and a conveying screw, and a transmission coupling connected with the rotating member. A drive coupling connected with a drive unit, such as a motor, is connected with the transmission coupling, thereby rotating the rotating member. For instance, there is a configuration that, accompanying to an installation of a toner case into an installed part of an image forming apparatus, the drive coupling is connected with the transmission coupling.

However, in such a configuration, there is a possibility that, before the installation of the toner case into the installed part is completed, the connection of the drive coupling with the transmission coupling is started. Accordingly, it is feared that, before the transmission coupling faces onto the drive coupling, the movement of the drive coupling to the transmission coupling is started, and then, the drive coupling is insufficiently connected with the transmission coupling.

SUMMARY

In accordance with an embodiment of the present disclosure, an image forming apparatus includes a toner case, a driving mechanism and an installed part. The toner case includes a container main body, a rotating member and a transmission coupling. The container main body is provided with a discharge port configured to discharge a toner. The rotating member is installed into the container main body. The transmission coupling is connected with the rotating member. The driving mechanism includes a drive coupling and a drive unit. The drive coupling is detachably connected with the transmission coupling. The drive unit rotates the drive coupling. Into the installed part, the toner case is detachably installed. The toner case has a lever supported onto the container main body. The driving mechanism has a movement mechanism. The movement mechanism works in accordance with the operation of the lever, in a state of installing the toner case into the installed part, to move the drive coupling from a disconnecting position to a connecting position with the transmission coupling.

Furthermore, in accordance with an embodiment of the present disclosure, a toner case includes a container main body, a rotating member and a transmission coupling. The container main body is provided with a discharge port configured to discharge a toner. The rotating member is installed into the container main body. The transmission coupling is connected with the rotating member. The toner case is installed in an image forming apparatus which includes a driving mechanism and an installed part. The driving mechanism includes a drive coupling and a drive unit. The drive coupling is detachably connected with the transmission coupling. The drive unit rotates the drive coupling. Into the installed part, the toner case is detachably installed. The toner case has a lever supported onto the container main body. The driving mechanism has a movement mechanism. The movement mechanism works in accordance with the operation of the lever, in a state of installing the toner case into the installed part, to move the drive coupling from a disconnecting position to a connecting position with the transmission coupling.

Moreover, in accordance with an embodiment of the present disclosure, a toner case is detachably installed into an installed part and includes a container main body, a rotating member, a transmission coupling and a lever. The container main body is provided with a discharge port configured to discharge a toner. The rotating member is installed into the container main body. The transmission coupling is connected with the rotating member and detachably connected with a drive coupling. The lever moves the drive coupling, in a state of installing the toner case into the installed part, from a disconnecting position to a connecting position with the transmission coupling.

The above and other objects, features, and advantages of the present disclosure will become more apparent from the following description when taken in conjunction with the accompanying drawings in which a preferred embodiment of the present invention is shown by way of illustrative example.

DETAILED DESCRIPTION

Figure 1:
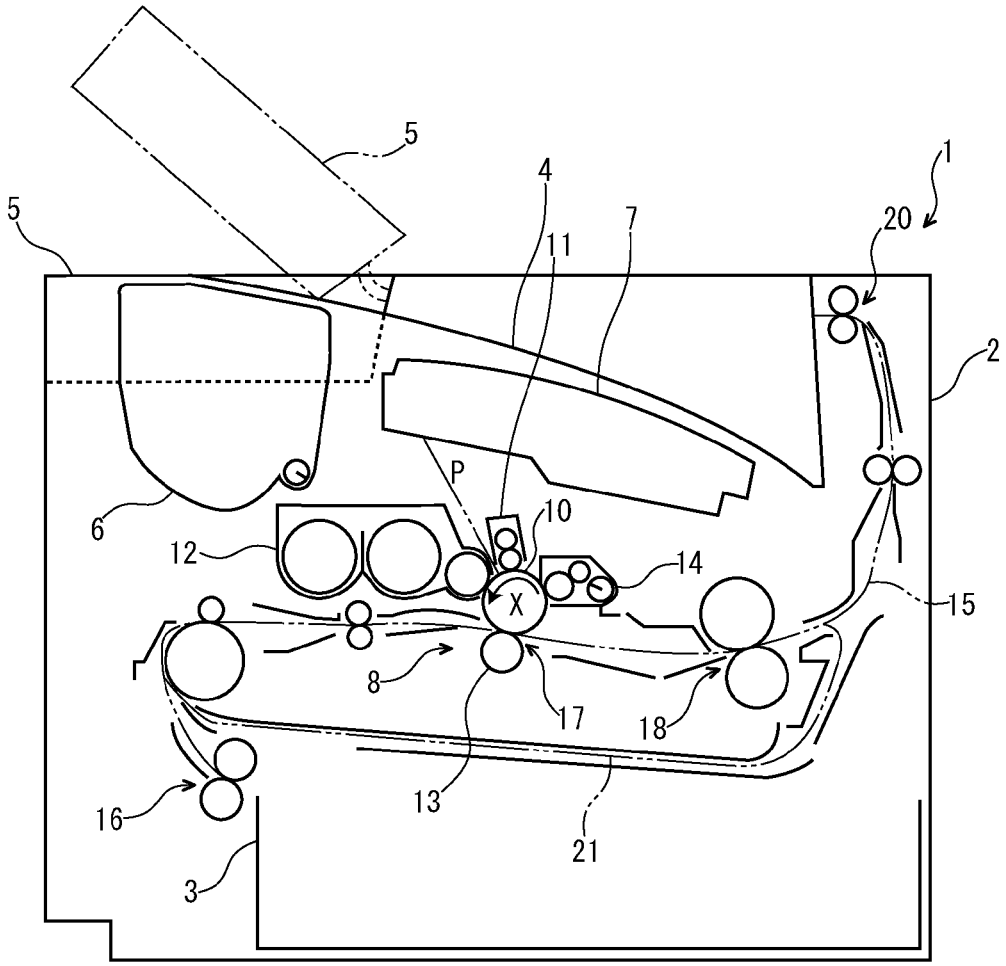
FIG. 1 is a schematic diagram schematically showing a printer according to an embodiment of the present disclosure.

With reference to FIG. 1, the entire structure of an electrographic printer 1 as an image forming apparatus will be described. FIG. 1 is a schematic diagram schematically showing the printer according to an embodiment of the present disclosure. Hereinafter, it will be described so that the front side of the printer 1 is positioned at the left-hand side of FIG. 1.

The printer 1 includes a box-formed printer main body 2. In a lower part of the printer main body 2, a sheet feeding cartridge 3 for storing sheets (not shown) is installed and, on the top surface of the printer main body 2, a sheet ejecting tray 4 is mounted. On the top surface of the printer main body 2, an upper cover 5 is openably/closably attached at the front of sheet ejecting tray 4 and, below the upper cover 5, a toner container 6 as a toner case is installed.

In an upper part of the printer main body 2, an exposure device 7 is installed below the sheet ejecting tray 4. The exposure device 7 is composed of a laser scanning unit (LSU). Below the exposure device 7, an image forming unit 8 is installed. In the image forming unit 8, a photosensitive drum 10 as an image carrier is rotatably attached. Around the photosensitive drum 10, a charger 11, a development device 12, a transfer roller 13 and a cleaning device 14 are located along a rotating direction (refer to arrow X in FIG. 1) of the photosensitive drum 10.

In the printer main body 2, a sheet conveying path 15 is arranged. At an upper stream end of the conveying path 15, a sheet feeder 16 is positioned and, at an intermediate stream part of the conveying path 15, a transferring unit 17 constructed of the photosensitive drum 10 and the transfer roller 13 is positioned. Furthermore, at a lower stream part of the conveying path 15, a fixing device 18 is positioned and, at a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Figure 2:
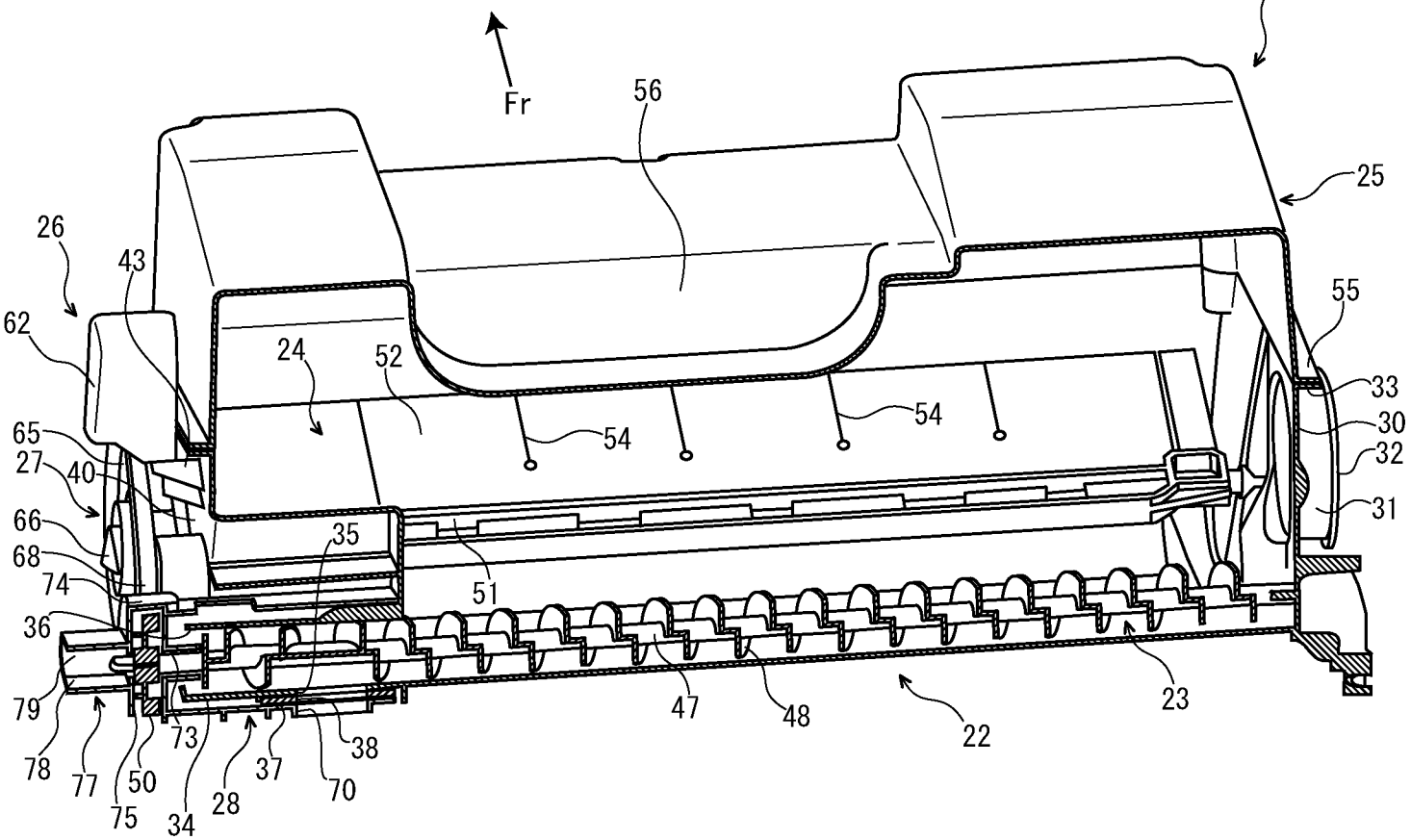
FIG. 2 is a back perspective sectional view showing a toner container in the printer according to the embodiment of the present disclosure.
Figure 3:
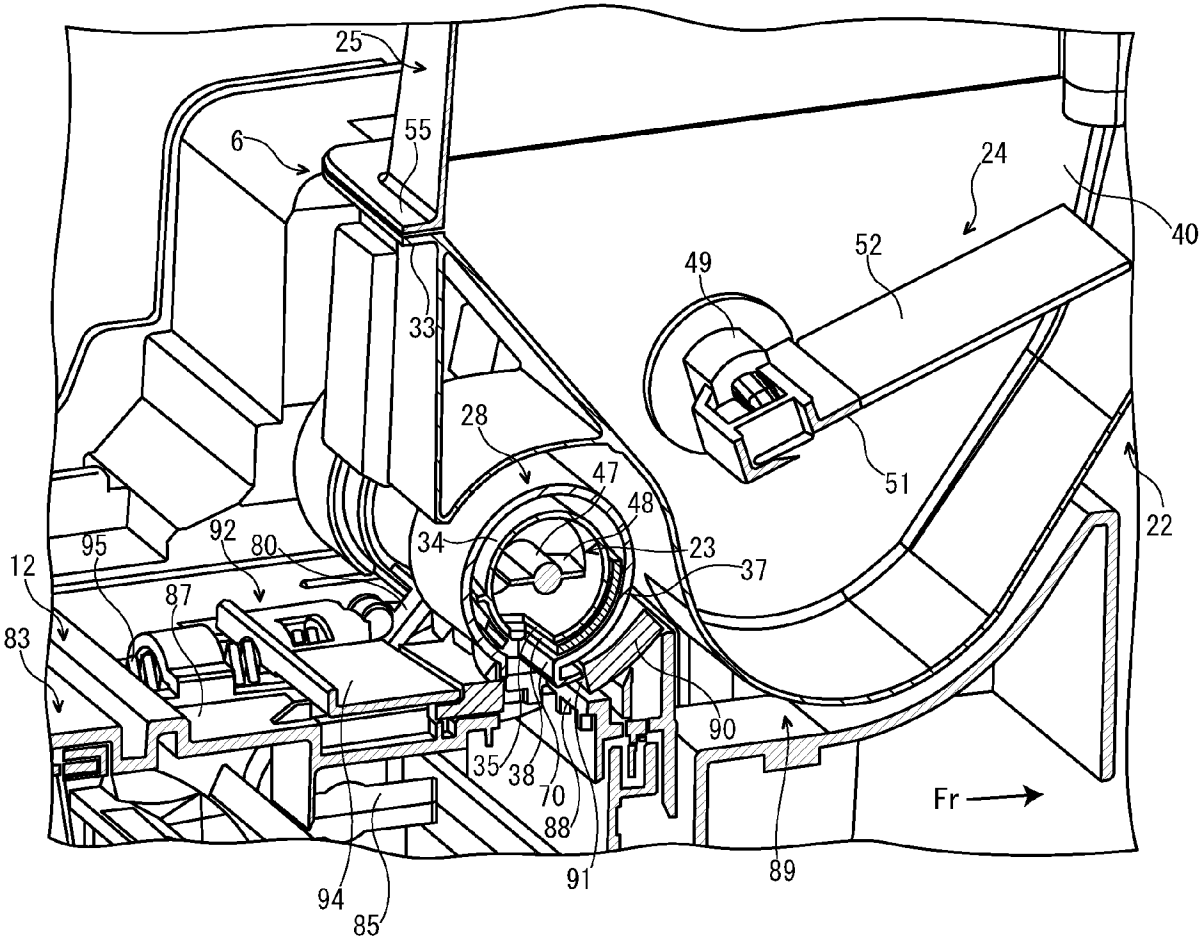
FIG. 3 is a back left perspective sectional view showing the printer in a situation, in which a container side shutter opens a discharge port and a development device side shutter opens a replenishment port, according to the embodiment of the present disclosure.
Figure 4:
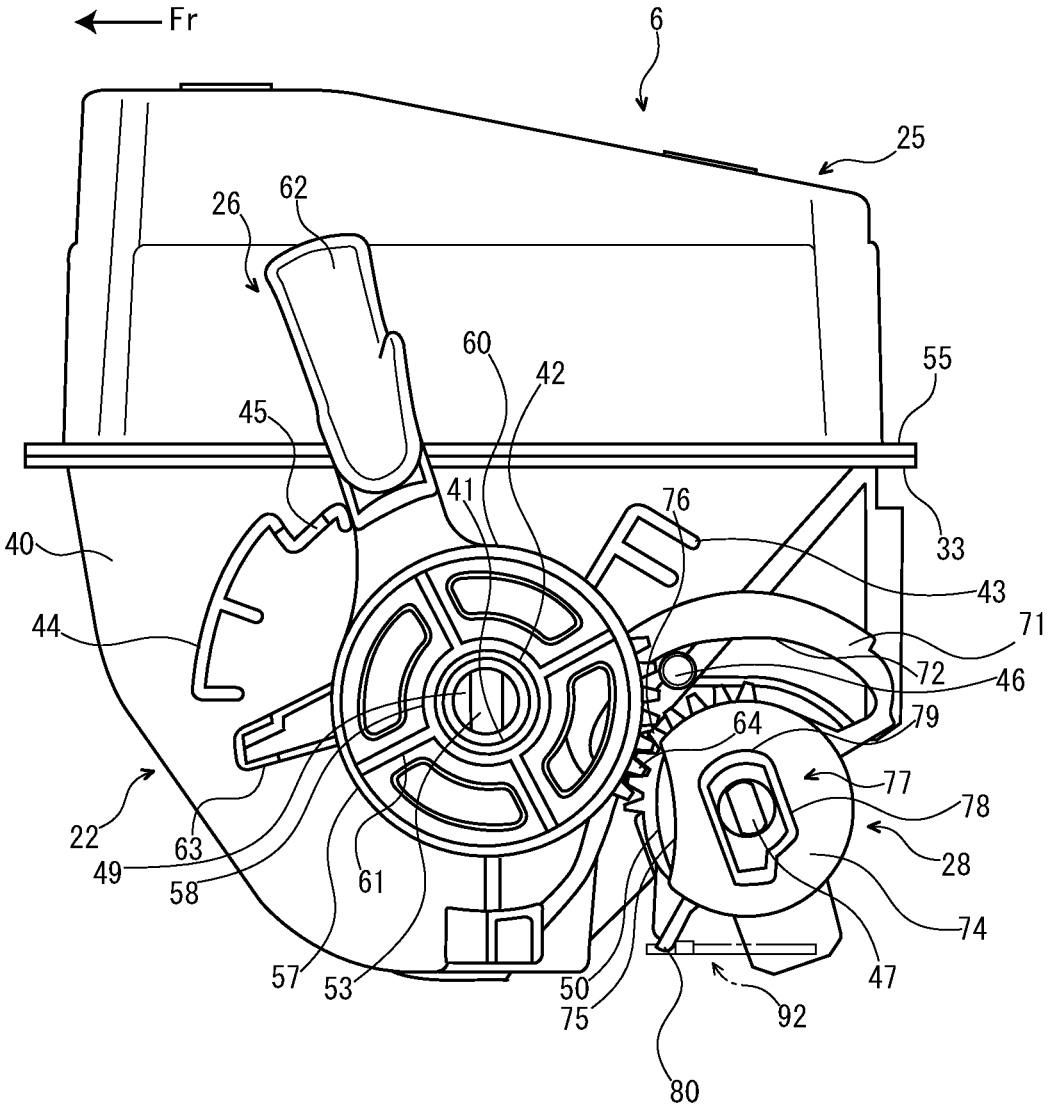
FIG. 4 is a right side view showing the toner container of the printer in a situation, in which a gripper of a lever is tilted forward, according to the embodiment of the present disclosure.
Figure 5:
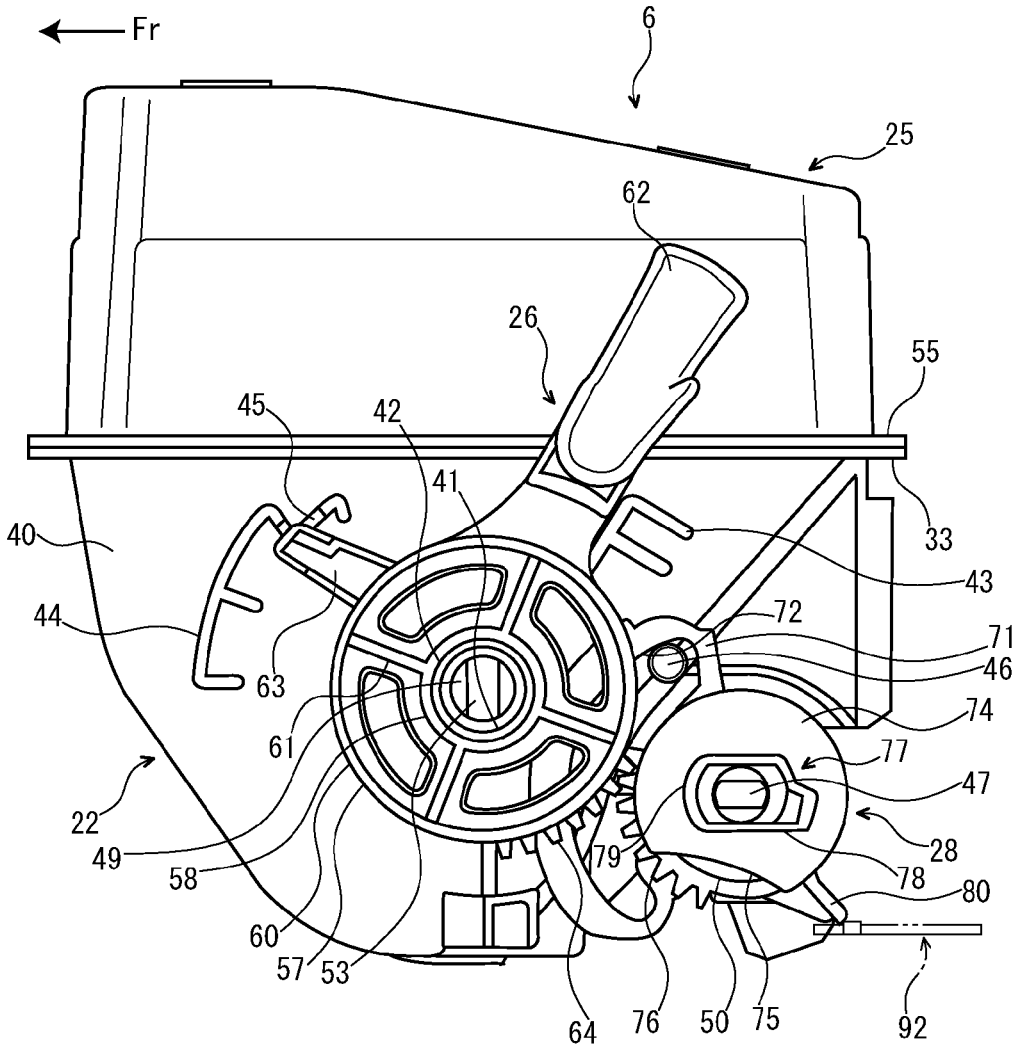
FIG. 5 is a right side view showing the toner container of the printer in a situation, in which the gripper of the lever is tilted backward, according to the embodiment of the present disclosure.
Figure 6:
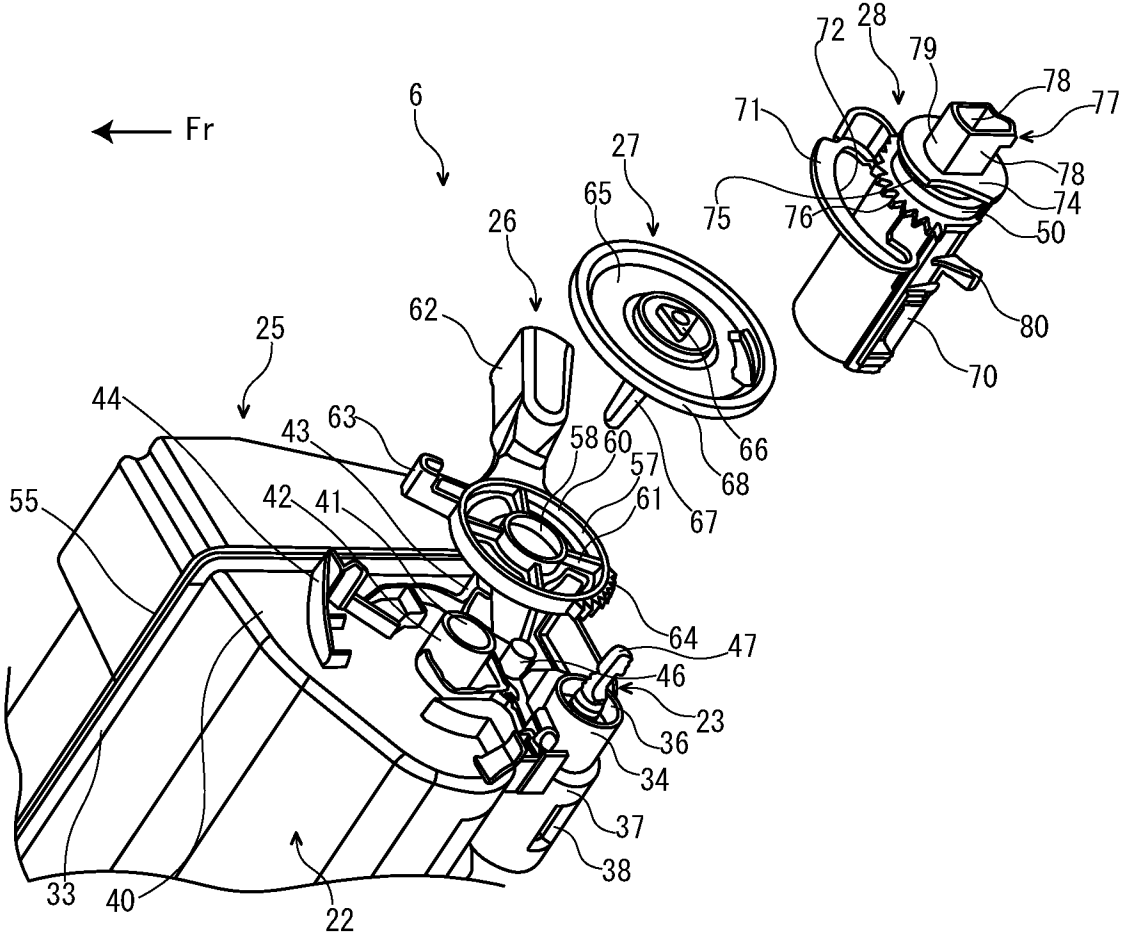
FIG. 6 is an exploded perspective view showing the toner container in the printer according to the embodiment of the present disclosure.
Figure 7:
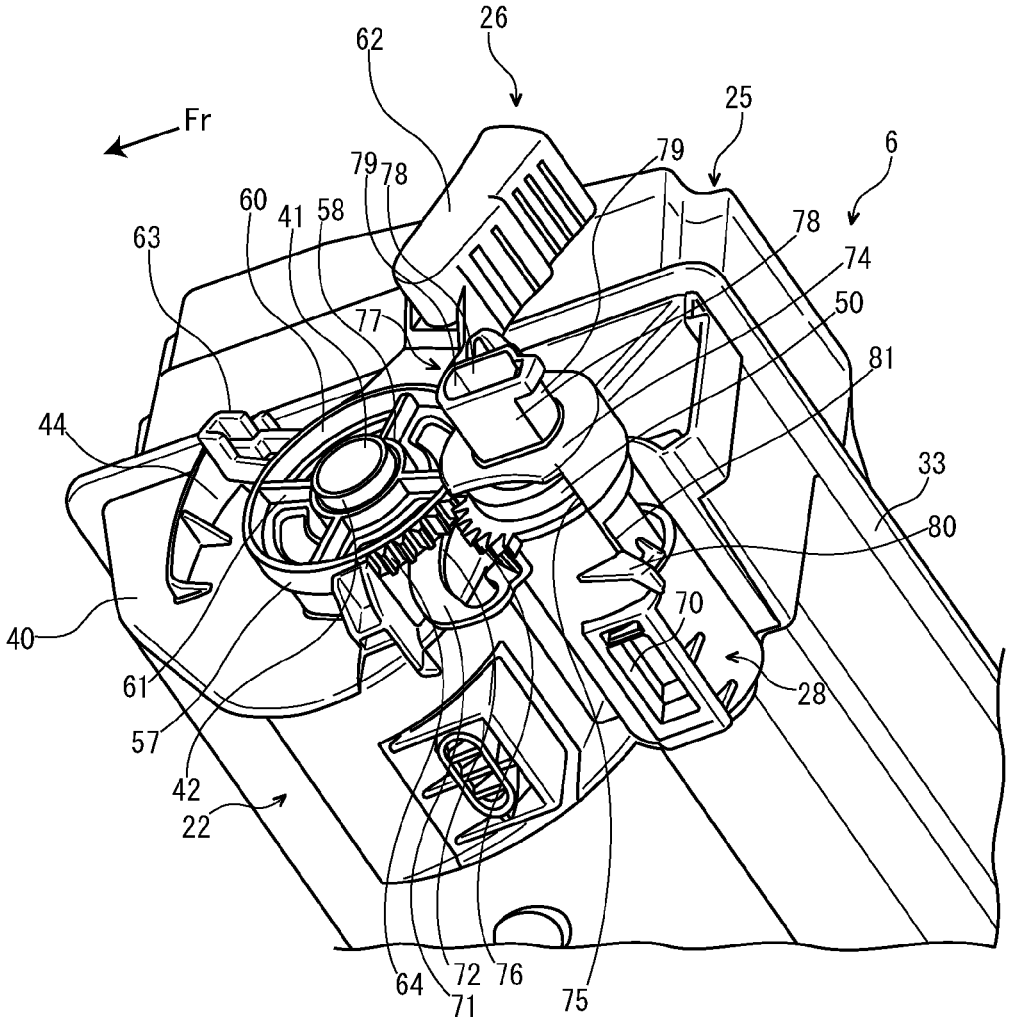
FIG. 7 is a right bottom perspective view showing the toner container in the printer according to the embodiment of the present disclosure.

Next, mainly with reference to FIGS. 2-7, the toner container 6 will be described in detail. FIG. 2 is a back perspective sectional view showing the toner container in the printer according to the embodiment of the present disclosure. FIG. 3 is a back left perspective sectional view showing the printer in a situation, in which a container side shutter opens a discharge port and a development device side shutter opens a replenishment port, according to the embodiment of the present disclosure. FIG. 4 is a right side view showing the toner container of the printer in a situation, in which a gripper of a lever is tilted forward, according to the embodiment of the present disclosure. FIG. 5 is a right side view showing the toner container of the printer in a situation, in which the gripper of the lever is tilted backward, according to the embodiment of the present disclosure. FIG. 6 is an exploded perspective view showing the toner container in the printer according to the embodiment of the present disclosure. FIG. 7 is aright bottom perspective view showing the toner container in the printer according to the embodiment of the present disclosure.

Figure 8:
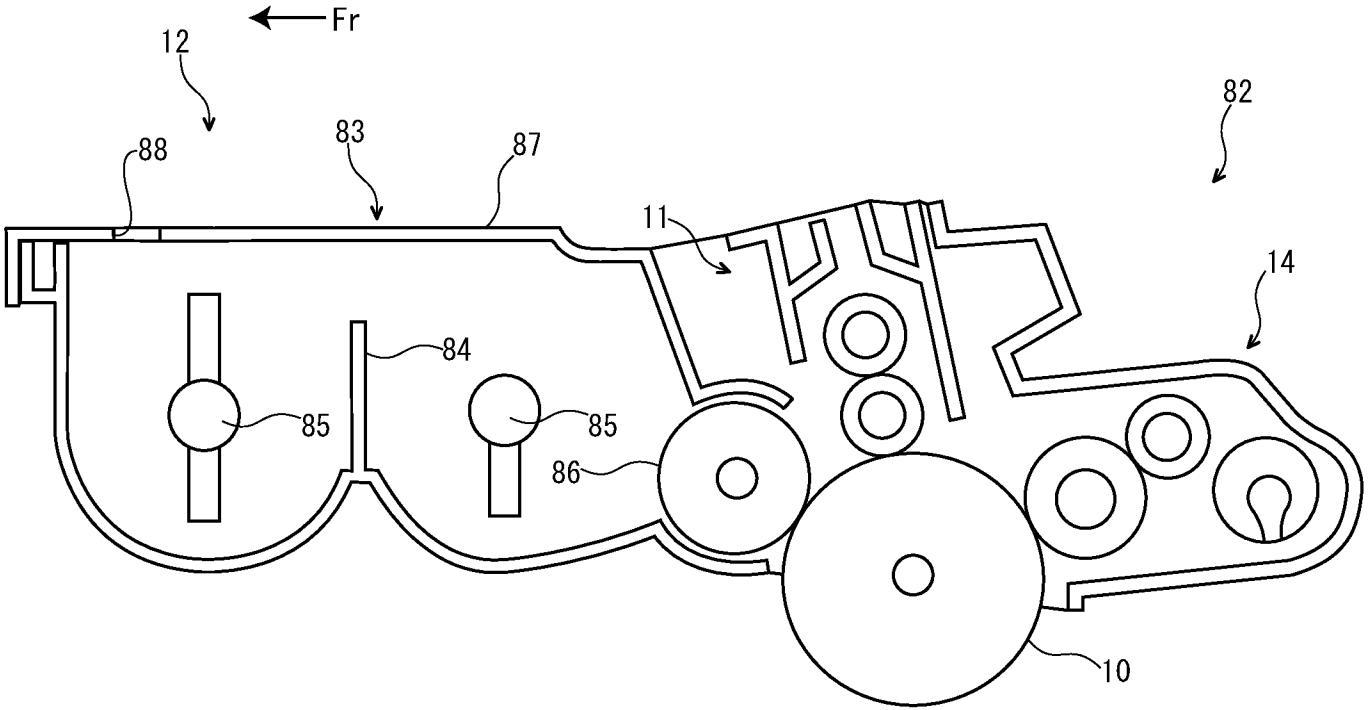
FIG. 8 is a schematic diagram schematically showing an image forming unit in the printer according to the embodiment of the present disclosure.

Arrow Fr suitably put on each figure indicates the front side of the printer 1 (FIG. 8 and more are also illustrated similarly). As FIG. 2 is the back perspective sectional view, the left-hand and right-hand sides of the figure are converse to the actual left and right sides. That is, the right-hand side of FIG. 2 is correspondent to the left side of the toner container 6 and the left-hand side of FIG. 2 is correspondent to the right side of the toner container 6.

As shown in FIG. 1, the toner container 6 is located below the upper cover 5 of the printer main body 2. The toner container 6 is detachably installed to the development device 12. For instance, when the toner is exhausted, the toner container 6 is made replaceable by opening the upper cover (refer to two-dot chain line on FIG. 1).

As shown in FIG. 2 and other figure, the toner container 6 includes a box-formed container main body 22 with a opened top surface, a conveying screw 23, a stirring paddle 24, a covering body 25, a lever 26, a transmitting member 27 and a container side shutter 28. The conveying screw 23 is installed as a rotating member in a lower rear part of the container main body 22. The stirring paddle 24 is installed as another rotating member near a center part of the container main body 22. The covering body 25 covers the top surface of the container main body 22. The lever 26 is attached to a right end of the container main body 22. The transmitting member 27 is placed on the right end of the container main body 22 together with the lever 26. The container side shutter 28 is attached to a right bottom end of the container main body 22. The transmitting member 27 is omitted in FIGS. 4, 5 and 7.

The container main body 22 is formed in an extended-shape in left and right directions or a horizontal direction to contain the toner. On a left end wall 30 of the container main body 22, a toner filling port 31 is formed and the toner filling port 31 is closed by a cap 32. On the circumference of a top end of the container main body 22, a main body side flange 33 is formed.

At the right bottom end of the container main body 22, a cylinder-formed discharging duct 34 is protruded to a right direction and, on a right end of the discharging duct 34, an aperture 36 is formed. As shown in FIG. 3 and other figure, in a bottom of the discharging duct 34, a discharge port 35 configured to discharge the toner is bored. On the circumference of a lower part of the discharging duct 34, a sealing member 37 is attached and, in the sealing member 37, a communication port 38 is bored at a correspondent position to the discharge port 35.

As shown in FIG. 4, at the center of a right end wall 40 of the container main body 22, a cylinder-formed boss 42 is protruded to aright direction (an outside direction). The boss 42 is penetrated with a communicating hole 41. On aright surface (an outside surface) of the right end wall 40 of the container main body 22, a first restrain rib 43 is protruded to an upper backward direction of the boss 42. On the right surface of the right end wall 40 of the container main body 22, a second restrain rib 44 is protruded to an upper forward direction of the boss 42. An upper part of the second restrain rib 44 is depressed so that a depression 45 is formed. On the right surface of the right end wall 40 of the container main body 22, a cylinder-formed protrusion 46 is formed below the first restrain rib 43.

As shown in FIG. 2 and other figure, the conveying screw 23 is formed in an extended-shape in the horizontal direction. The conveying screw 23 includes a bar-formed rotating shaft and a spiral fin 48 concentrically mounted on the circumference of the rotating shaft 47. A left end of the rotating shaft 47 is pivotally supported by the left end wall 30 of the container main body 22. Right side parts of the rotating shaft 47 and spiral fin 48 are inserted into the discharging duct 34. A right end of the rotating shaft 47 protrudes from the discharging duct 34 via the aperture 36 to the right direction and, onto the protruding part, a conveying gear 50 is fixedly attached.

The stirring paddle 24 is located below and in front of the conveying screw 23 and formed in an extended-shape in the horizontal direction. The stirring paddle 24 includes a frame plate-formed supporting frame 51 and a sheet-formed stirring fin 52 supported by the supporting frame 51. Left and right ends (both horizontal ends) of the supporting frame 51 are pivotally supported by the left end wall 30 and right end wall 40 of the container main body 22 via bearings 49 (refer to FIG. 3, hereinafter, it is called as "a bearing 49 of a stirring paddle 24"). As shown in FIG. 4 and other figure, on the bearing 49 of the stirring paddle 24 attached onto the right end wall 40, an engaging reception 53 is formed at a correspondent position to the communication hole 41 of the boss 42.

The stirring fin 52 is formed out of plastic sheet, e.g. lumirror. As shown in FIG. 2 and other figure, one side of the stirring fin 52 is fixedly attached onto the supporting frame 51 along the horizontal direction. The stirring fin 52 is provided with a plurality of slits 54.

On a bottom end of the covering body 25, a covering body side flange 55 is formed in the correspondent form to the main body side flange 33 of the container main body 22. The main body side flange 33 and covering body side flange 55 are ultrasonic-welded together so that the container main body 22 and covering body 25 are unified. In a center of the horizontal direction of the covering body 25, a hollow 56 is formed.

As shown in FIG. 4 and other figure, the lever 26 includes a lever main body 57 with a circular profile in a side view. The lever main body 57 includes a small-diameter cylinder 58, a large-diameter cylinder 60 attached around the circumference of the small-diameter cylinder 58 and four radially extended connecters 61 of connecting the small-diameter cylinder 58 and large-diameter cylinder 60 with each other. The small-diameter cylinder 58 is fitted onto the circumference of the boss 42 arranged on the right end wall 40 of the container main body 22. Accordingly, the lever 26 is rotatably supported onto the container main body 22.

On an upper part of the large-diameter cylinder 60, a gripper 62 is protruded. A top end of the gripper 62 extends to the right side of the covering body 25. In the gripper 62, forward tilted angle is restricted by the second restrain rib 44 (refer to FIG. 4) and backward tilted angle is restricted by the first restrain rib 43 (refer to FIG. 5). On an upper part of the large-diameter cylinder 60, a protruding piece 63 is formed in front of the gripper 62. As shown in FIG. 5, the protruding piece 63 engages with the depression 45 of the second restrain rib 44 in a state that the gripper 62 is tilted backward. On the circumference of a lower rear part of the large-diameter cylinder 60, a lever side gear 64 is formed.

As shown in FIG. 6 and other figure, the transmitting member 27 includes a disc-formed transmitting member main body 65. On a right surface (an outside surface) of the transmitting member main body 65, a transmission coupling 66 is protruded in the form of a triangle pole in a side view. On a left surface (an inside surface) of the transmitting member main body 65, an engaging piece 67 is protruded. The engaging piece 67 is inserted into the communication hole 41 bored in the boss 42 of the container main body 22, and then, engaged with the engaging reception 53 (refer to FIG. 4 and other figure) formed on the bearing 49 of the stirring paddle 24. Accordingly, the transmitting member 27 and stirring paddle 24 are connected with each other to rotate in a body. It is thus clear that the transmission coupling 66 and stirring paddle 24 are connected with each other.

As shown in FIG. 6, on the circumference of the transmitting member main body 65, a transmission gear 68 is formed. The transmission gear 68 meshes with the conveying gear 50 fixedly attached onto the rotating shaft 47 of the conveying screw 23, thereby rotating the conveying screw 23 in accordance with the rotation of the transmitting member 27. In FIG. 6, the conveying gear 50 and rotating shaft 47 are illustrated in the separated state from each other. It is thus clear that the transmission coupling 66 and conveying screw 23 are connected with each other.

The container side shutter 28 is formed in a cylinder-liked shape and rotatably fitted onto the circumference of the discharging duct 34 of the container main body 22. In a lower surface of the container side shutter 28, a discharge aperture 70 is bored. As shown in FIG. 3 and other figure, the discharge aperture 70 is formed at a correspondent position to the discharge port 35 of the container main body 22 and the communication port 38 of the sealing member 37.

As shown in FIG. 4 and other figure, on the container side shutter 28, a roughly fan-formed guiding piece 71 is protruded. In the guiding piece 71, an arc-formed guiding hole 72 is formed and, with the guiding hole 72, the protrusion 46 of the container main body 22 is engaged.

As shown in FIG. 2 and other figure, in the container side shutter 28, a cylinder-formed bearing 73 is formed and, into the bearing 73, the right end of the rotating shaft 47 of conveying screw 23 is pivotally supported. On a right side part of the bearing 73, a gear box 74 is attached and the gear box 74 houses the conveying gear 50. As shown in FIG. 7 and other figure, in the gear box 74, a communication aperture 75 is formed, and then, it is possible to house the conveying gear 50 in the gear box 74 via the communication aperture 75.

The container side shutter 28 is provided with a shutter side gear 76. The shutter side gear 76 meshes with the lever side gear 64 of the lever 26, thereby turning the container side shutter 28 in the opposite direction to the lever 26 in accordance with the turn of the lever 26. On the right end of the container side shutter 28, a locking piece 77 is attached. The locking piece 77 includes a pair of plane parts 78 facing to each other and a pair of curving parts 79, each of which is connected with respective ends of the plane parts 78. The locking piece 77 is formed with an elliptic section (non-circular section). Outside a lower part of the container side shutter 28, a pressing protrusion 80 is formed at the right side of the discharge aperture 70 and a window 81 is formed above the pressing protrusion 80.

Figure 9:
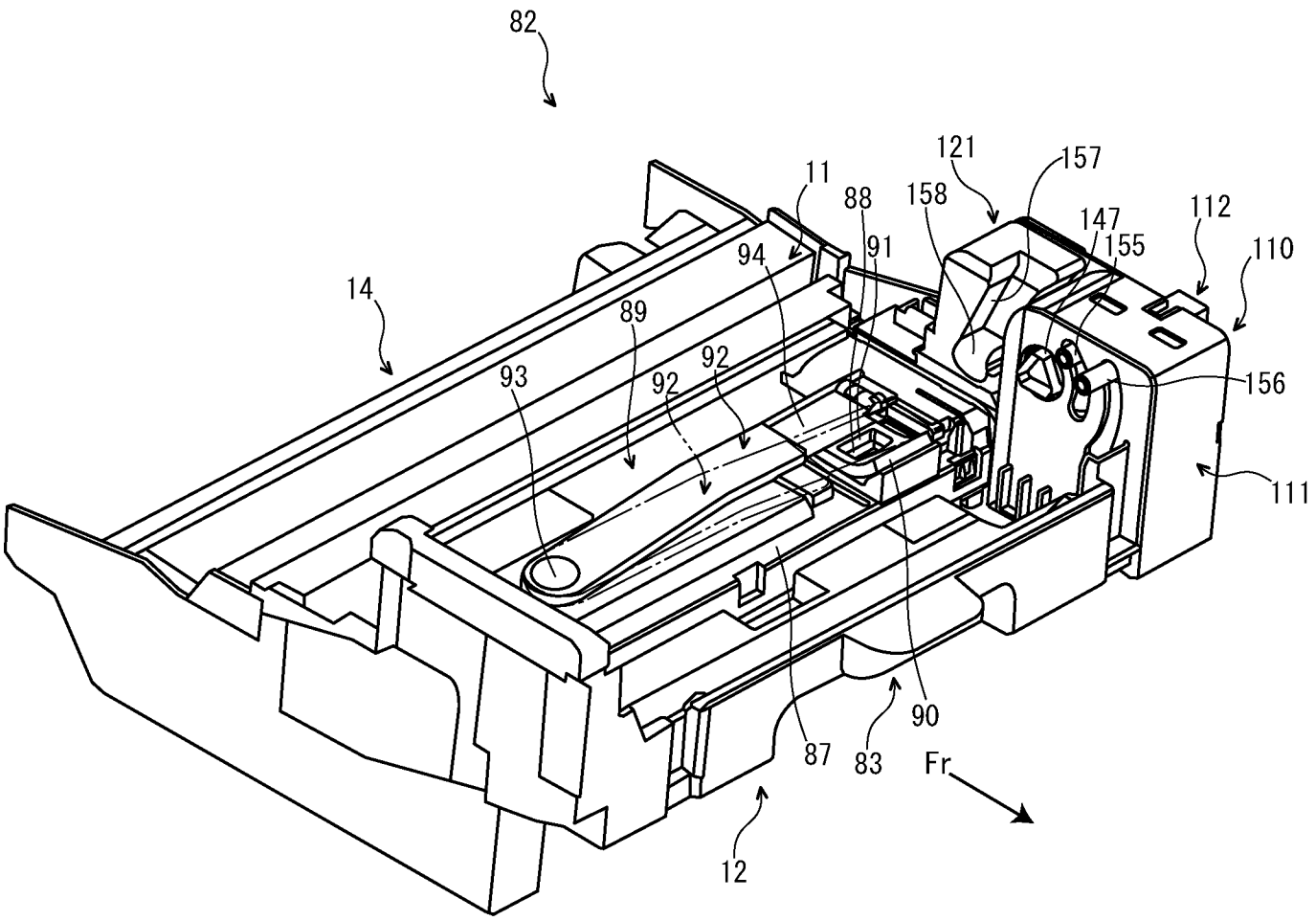
FIG. 9 is a front left perspective view showing the image forming unit in the printer according to the embodiment of the present disclosure.
Figure 10:
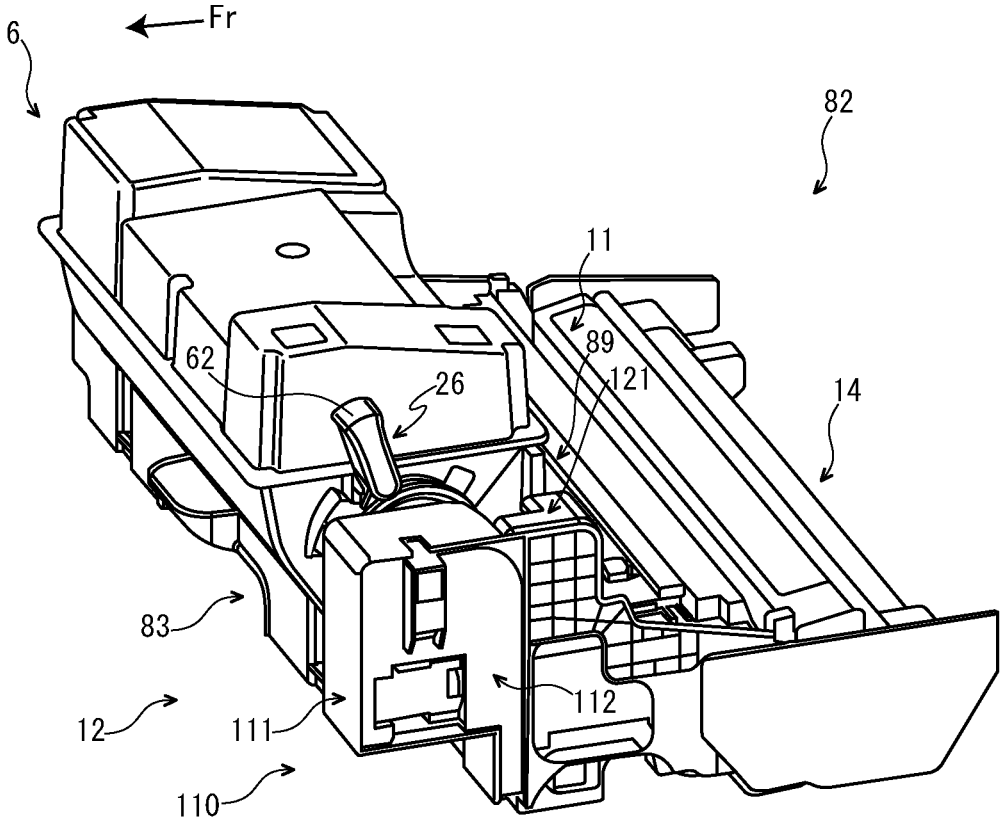
FIG. 10 is a front right perspective view showing the toner container in a situation of being installed into an installed part of a development device in the printer according to the embodiment of the present disclosure.
Figure 11:
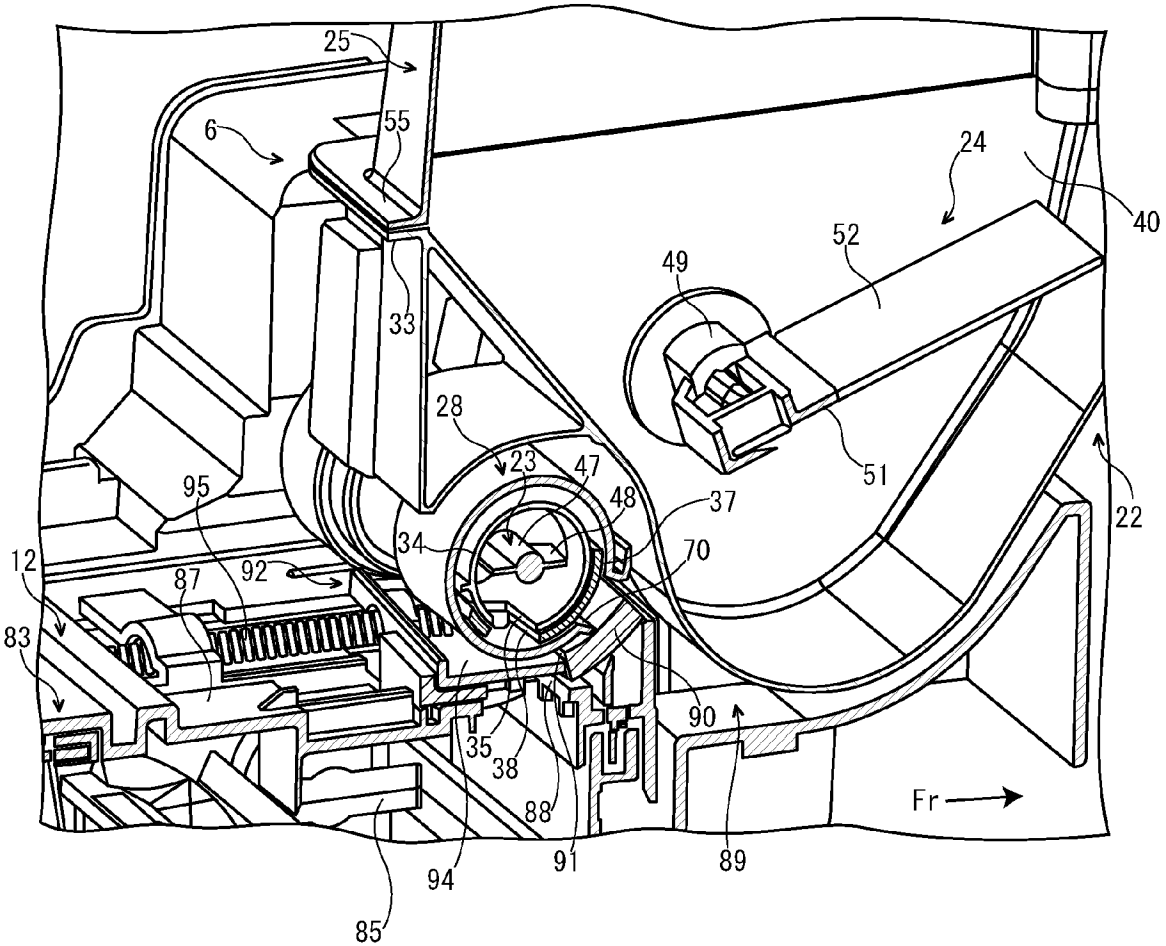
FIG. 11 is aback left perspective sectional view showing the printer in a situation, in which the container side shutter closes the discharge port and the development device side shutter closes the replenishment port, according to the embodiment of the present disclosure.

Next, with reference to FIGS. 3 and 8-11, the development device 12 will be described in detail. As mentioned above, FIG. 3 is a back left perspective sectional view showing the printer in a situation, in which the container side shutter opens a discharge port and a development device side shutter opens a replenishment port, according to the embodiment of the present disclosure. FIG. 8 is a schematic diagram schematically showing an image forming unit in the printer according to the embodiment of the present disclosure. FIG. 9 is a front left perspective view showing the image forming unit in the printer according to the embodiment of the present disclosure. FIG. 10 is a front right perspective view showing the toner container in a situation of being installed into an installed part of the development device in the printer according to the embodiment of the present disclosure. FIG. 11 is a back left perspective sectional view showing the printer in a situation, in which the container side shutter closes the discharge port and the development device side shutter closes the replenishment port, according to the embodiment of the present disclosure.

As shown in FIG. 8, the development device 12 is integrated with the photosensitive drum 10, charger 11 and cleaning device 14 so that an image forming unit 82 is composed. The development device 12 is provided with a box-formed development device main body 83. At the center inside the development device main body 83, a partition 84 extending in upper and lower directions or a perpendicular direction is formed and, in front and behind the partition 84, stirring members 85 are respectively installed. Each stirring member 85 is rotatably supported onto the development device main body 83. Inside the development device main body 83, below and behind the rear stirring member 85, a developing roller 86 is installed. The developing roller 86 is rotatably supported onto the development device main body 83 and comes into contact with the surface of the photosensitive drum 10.

As shown in FIG. 9, on the top surface side of the development device main body 83, an installed part 89 is provided. As shown in FIG. 10, into the installed part 89, the toner container 6 is detachably installed.

As shown in FIG. 3 and other figure, in a top wall 87 of the development device main body 83, a replenishment port 88 is bored in the perpendicular direction. On a top surface of the top wall 87 of the development device main body 83, a sealing member 90 is fixedly attached around the replenishment port 88. The sealing member 90 is made of elastic material, e.g. sponge. As shown in FIG. 9, in the sealing member 90, a replenishment aperture 91 is formed at a correspondent position to the replenishment port 88 of the development device main body 83.

At the top surface side of the top wall 87 of the development device main body 83, a development device side shutter 92 is attached. The development device side shutter 92 is formed in a plane-liked shape extended in the horizontal direction. At a left end of the development device side shutter 92, a supporting pivot 93 is provided. The development device side shutter 92 is adapted to turn around the supporting pivot 93 in a forward or backward direction along the top surface side of the top wall 87 of the development device main body 83.

On a right side part of the development device side shutter 92, an opening/closing part 94 is provided. A bottom surface of the opening/closing part 94 comes into contact with a top surface of the sealing member 90. In accordance with the turn of the development device side shutter 92 around the supporting pivot 93, the opening/closing part 94 opens or closes the replenishment port 88 of the development device main body 83 and the replenishment aperture 91 of the sealing member 90. Hereinafter, one position of the opening/closing part 94 in a case where the replenishment port 88 of the development device main body 83 and the replenishment aperture 91 of the sealing member 90 are opened (refer to FIG. 3) is called as an opening position. Another position of the opening/closing part 94 in a case where the replenishment port 88 of the development device main body 83 and the replenishment aperture 91 of the sealing member 90 are closed (refer to FIG. 11) is called as a closing position. The opening/closing part 94 is biased to the closing position by a coil spring 95 installed between the development device main body 83 and development device side shutter 92.

Figure 12:
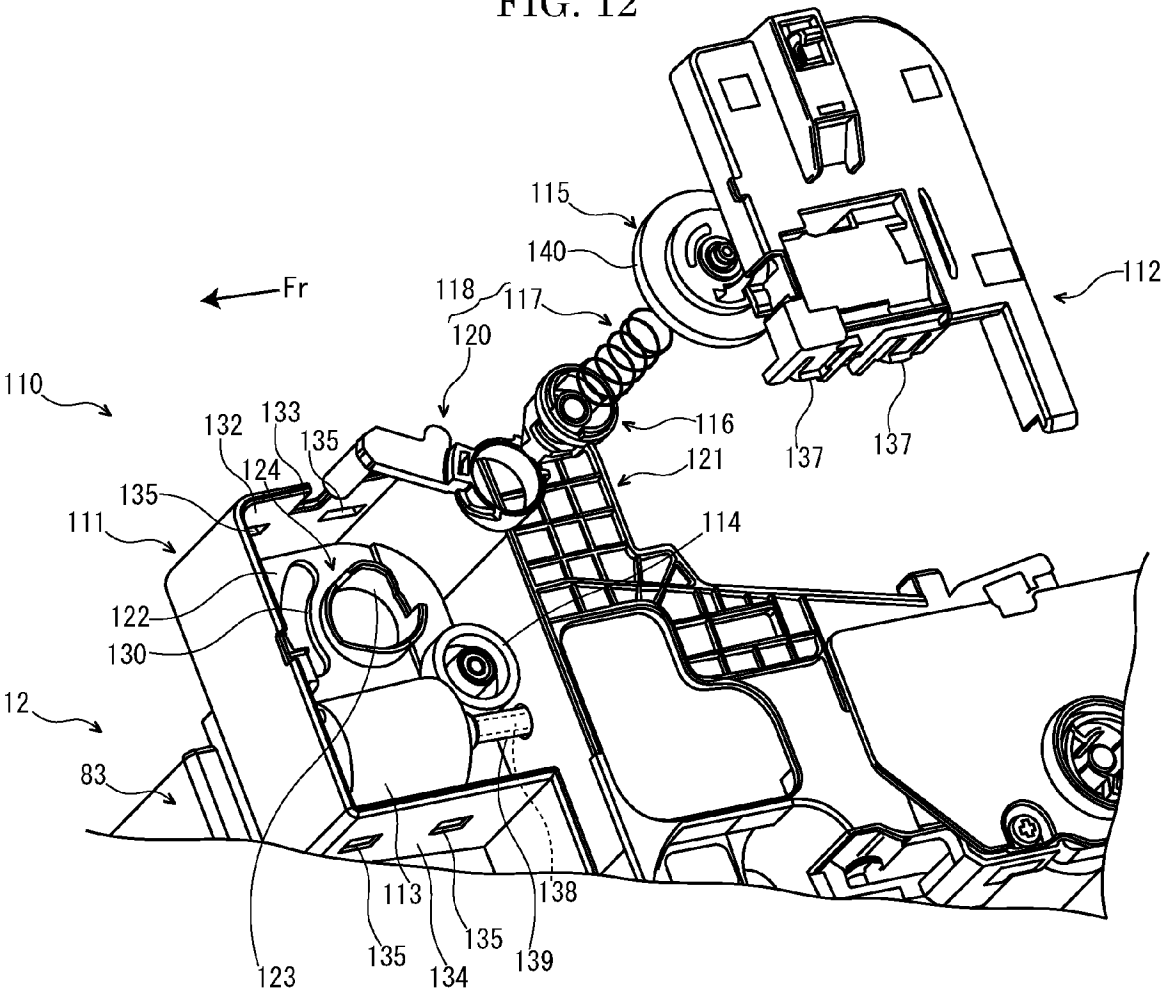
FIG. 12 is a front right exploded perspective view showing a driving mechanism in the printer according to the embodiment of the present disclosure.
Figure 13:
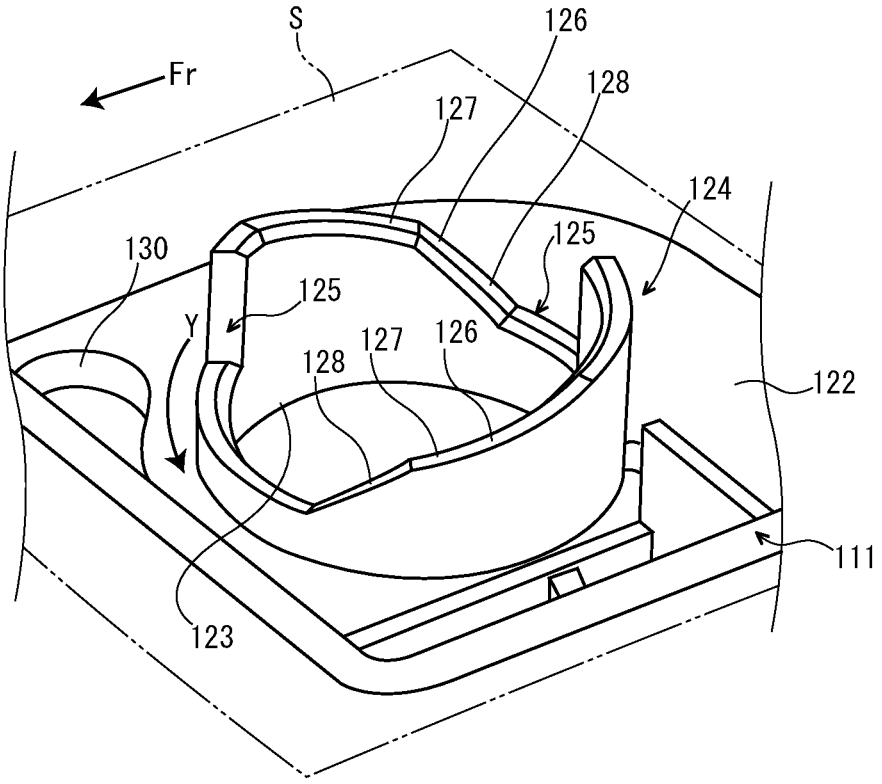
FIG. 13 is a right bottom perspective view showing an insertion tube and its circumference in the driving mechanism of the printer according to the embodiment of the present disclosure.
Figure 14:
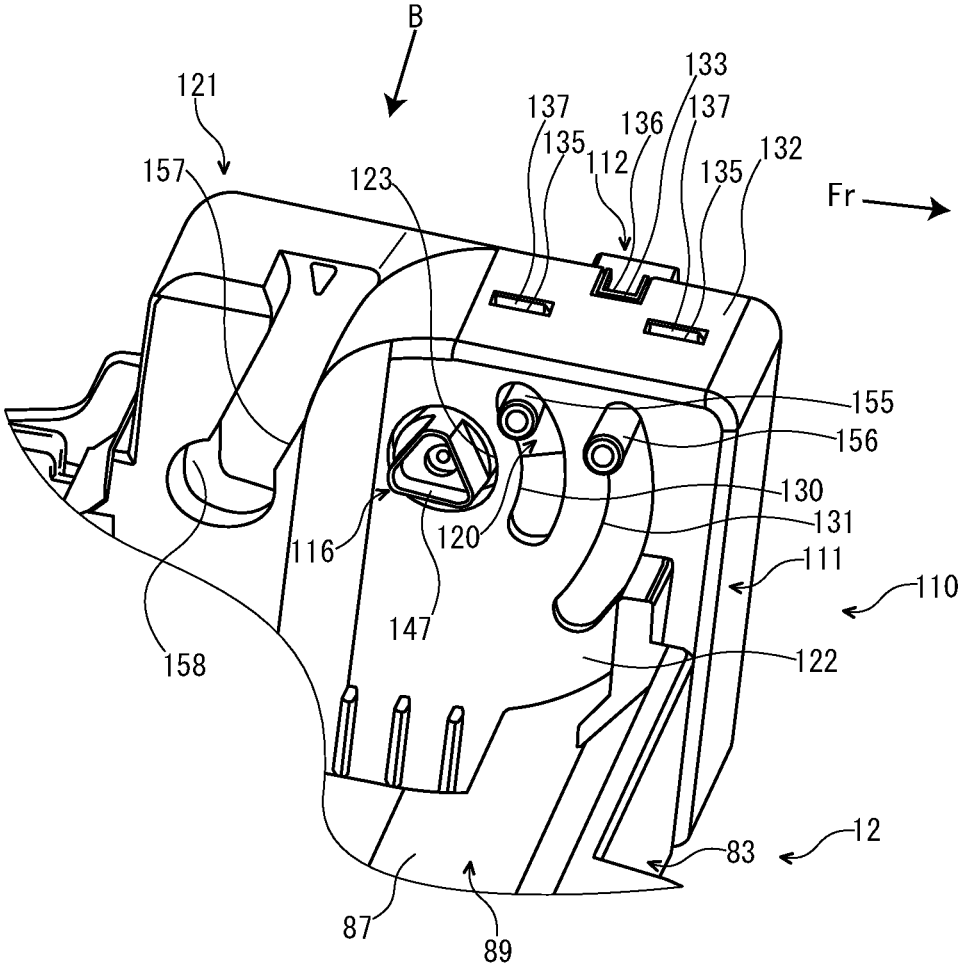
FIG. 14 is a left perspective view showing the driving mechanism in a situation, in which a drive coupling is arranged at its connecting position, in the printer according to the embodiment of the present disclosure.
Figure 15:
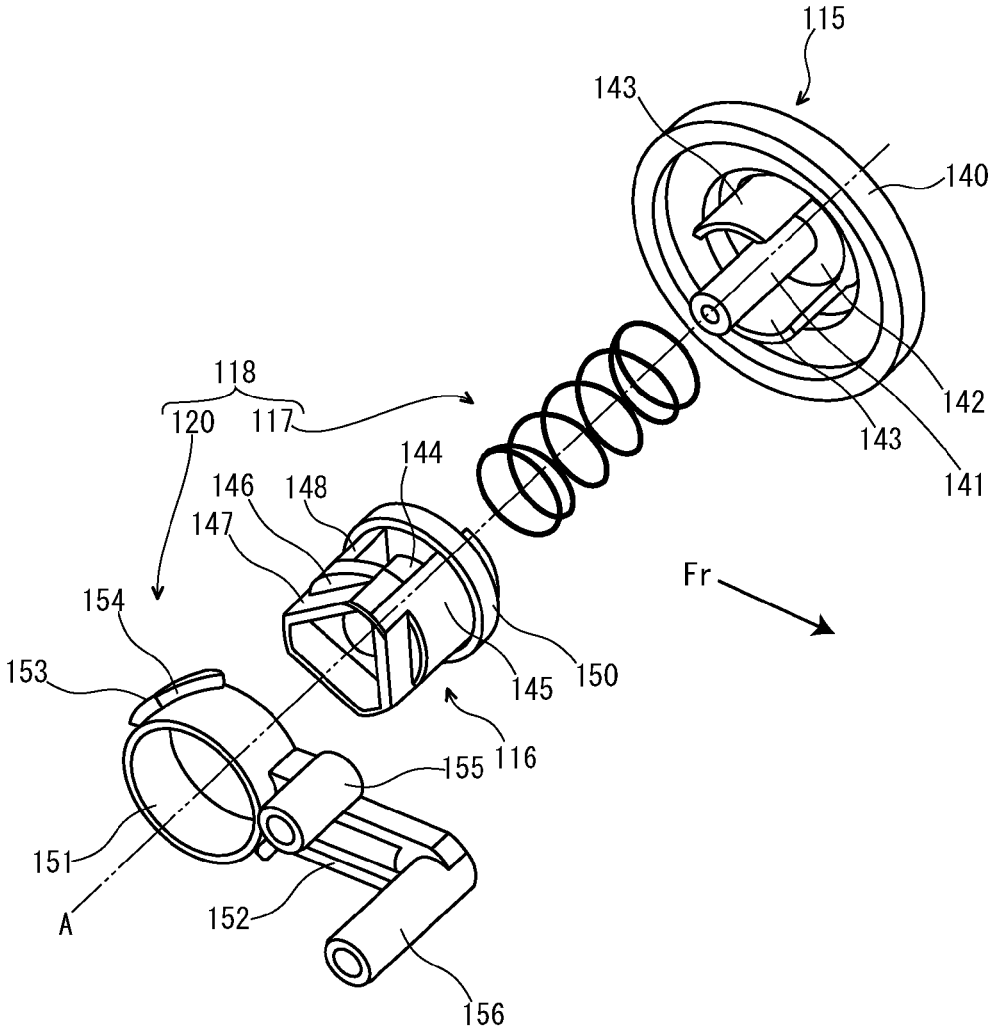
FIG. 15 is an exploded perspective view showing a driving member, the drive coupling and a movement mechanism in the driving mechanism of the printer according to the embodiment of the present disclosure.
Figure 16:
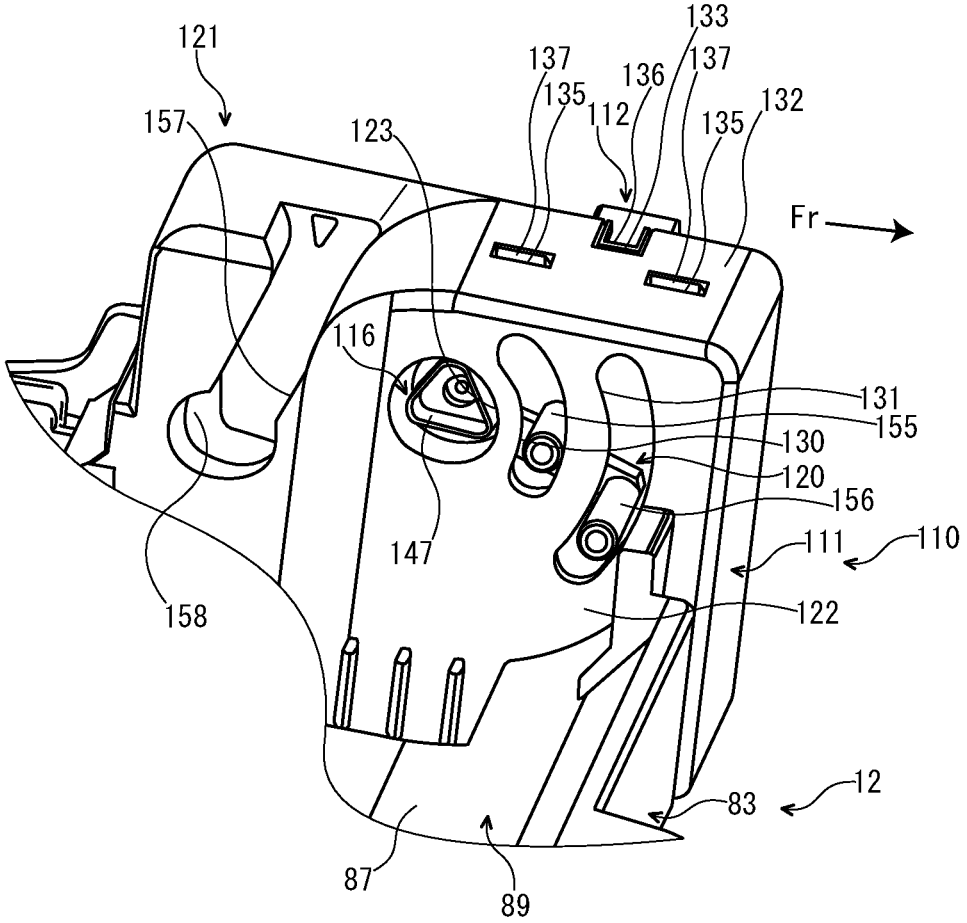
FIG. 16 is a left perspective view showing the driving mechanism in a situation, in which the drive coupling is arranged at its disconnecting position, in the printer according to the embodiment of the present disclosure.

As shown in FIG. 9, on the right end side of the development device main body 83, a driving mechanism 110 is installed. In the following, with reference to FIGS. 12-16, the driving mechanism 110 will be described. FIG. 12 is a front right exploded perspective view showing the driving mechanism in the printer according to the embodiment of the present disclosure. FIG. 13 is a right bottom perspective view showing an insertion tube and its circumference in the driving mechanism of the printer according to the embodiment of the present disclosure. FIG. 14 is a left perspective view showing the driving mechanism in a situation, in which a drive coupling is arranged at its connecting position, in the printer according to the embodiment of the present disclosure. FIG. 15 is an exploded perspective view showing a driving member, the drive coupling and a movement mechanism in the driving mechanism of the printer according to the embodiment of the present disclosure. FIG. 16 is a left perspective view showing the driving mechanism in a situation, in which the drive coupling is arranged at its disconnecting position, in the printer according to the embodiment of the present disclosure.

As shown in FIG. 12, the driving mechanism 110 includes a casing member 111, a covering member 112, a motor 113, an idle gear 114, a driving member 115, a drive coupling 116, a coil spring 117, a pressing member 120 and a locking member 121. The casing member 111 is formed in a box-liked shape with an opened right surface. The covering member 112 covers the right surface of the casing member 111. The motor 113 is a drive unit installed into a lower part of the casing member 111. The idle gear 114 is installed in the center of a rear part of the casing member 111. The driving member 115 is installed into an upper part of the casing member 111. The drive coupling 116 is attached to the driving member 115. The coil spring 117 is a biasing member installed between the driving member 115 and drive coupling 116. The pressing member 120 is attached to the drive coupling 116 and composes a movement mechanism 118 together with the coil spring 117. The locking member 121 is attached behind the casing member 111.

The casing member 111 is formed together with the development device main body 83 in a body. In an upper rear part of a left side plate 122 of the casing member 111, a circular coupling insertion hole 123 is bored in the horizontal direction. On a right surface (an inside surface) of the left side plate 122 of the casing member 111, a cylinder-formed insertion tube 124 is protruded from the circumference of the coupling insertion hole 123. As shown in FIG. 13, a protruded end of the insertion tube 124 is depressed so that a pair of engaging gaps 125 is formed. On the engaging gaps 125, casing member side inclinations 126 are respectively formed so as to incline from a perpendicular plane to the horizontal direction (in the embodiment, a parallel plane to the inside and outside surfaces of the left side plate 122; hereinafter, it is called as "a perpendicular plane S"). The casing member side inclination 126 is provided with a gently inclined part 127 inclined at a predetermined angle with the perpendicular plane S and a steeply inclined part 128 inclined at a steeper angle than the gently inclined part 127 with the perpendicular plane S. The steeply inclined part 128 is positioned at an upper stream from the gently inclined part 127 in a rotating direction Y (a counter clockwise direction in a right side view).

As shown in FIG. 14, in the left side plate 122 of the casing member 111, a first insertion hole 130 is bored in the horizontal direction in front of the coupling insertion hole 123. The first insertion hole 130 is formed in an arc shape around the coupling insertion hole 123. In the left side plate 122 of the casing member 111, a second insertion hole 131 is bored in the horizontal direction in front of the first insertion hole 130. The second insertion hole 131 is formed in an arc shape around the coupling insertion hole 123. The top end of the second insertion hole 131 is located at the same level as the top end of the first insertion hole 130 and the bottom end of the second insertion hole 131 is located at a lower level than the bottom end of the first insertion hole 130.

As shown in FIG. 12, the center in the forward and backward directions of a top plate 132 of the casing member 111 is depressed so that a fitting gap 133 is formed. At both sides in the forward and backward directions of the top plate 132 and a bottom plate 134 of the casing member 111, pairs of hook holes 135 are bored.

As shown in FIG. 14, at the center in the forward and backward directions of the top end of the covering member 112, a fitting protrusion 136 is formed. At both sides in the forward and backward directions of the top and bottom ends (in FIG. 14, the top end is illustrated) of the covering member 112, pairs of hooks 137 are formed. Accordingly, the fitting protrusion 136 of the covering member 112 is fitted into the fitting gap 133 of the casing member 111 and each hook 137 of the covering member 112 is engaged with each hook hole 135 of the casing member 111, thereby connecting the covering member 112 with the casing member 111.

As shown in FIG. 12, onto the motor 113, a motor shaft 138 extending backward is attached and, onto the circumference of the motor shaft 138, a worm gear 139 is fixedly attached. The motor 113 is connected with a motor driver (not shown) so as to drive by electric current from the motor driver.

The idle gear 114 is rotatably supported onto the casing member 111. The idle gear 114 meshes with the worm gear 139. When the motor shaft 138 and worm gear 139 rotate in accordance with drive of the motor 113, the rotation is transmitted to the idle gear 114, thereby rotating the idle gear 114.

The driving member 115 is rotatably supported onto the covering member 112. On the circumference of the driving member 115, a driving gear 140 is formed and the driving gear 140 meshes with the idle gear 114. Accordingly, when the idle gear 114 rotates, the rotation is transmitted to the driving member 115, thereby rotating the driving member 115. As shown in FIG. 15 and other figure, at the center of the left side surface of the driving member 115, a cylinder-formed insertion protrusion 141 is formed and, around the insertion protrusion 141, an annular spring contact face 142 is formed. From the circumference of the spring contact face 142, a pair of insertion plates 143 is protruded. The insertion plate 143 is formed in an arc shape around the insertion protrusion 141.

The drive coupling 116 includes a cylinder-formed inside tube 144, a cylinder-formed outside tube 145, an annular spring reception 146 and a connecter 147. The cylinder-formed outside tube 145 is disposed around the inside tube 144. The annular spring reception 146 is adapted to connect the left end of the inside tube 144 and the left end of the outside tube 145 with each other. The connecter 147 with a triangle profile in a side view is formed onto the left surface of the spring reception 146 in a body.

Into the inside tube 144, the insertion protrusion 141 of the driving member 115 is inserted. The outside tube 145 is depressed so that a pair of insertion gaps 148 is formed and, into the insertion gap 148, the insertion plate 143 of the driving member 115 is inserted. Due to such a configuration, the drive coupling 116 can be rotated together with the driving member 115 in a body and be moved in the horizontal direction from the driving member 115. Hereinafter, one position of the drive coupling 116 in a case where it has moved to the left side (refer to FIG. 14) is called as "a connecting position" of the drive coupling 116. Another position of the drive coupling 116 in a case where it has moved to the right side (refer to FIG. 16) is called as "a disconnecting position" of the drive coupling 116. As shown in FIG. 15, on the circumference of the right end of the outside tube 145, an annular ring 150 is fixedly attached.

The connecter 147 is protruded from the coupling insertion hole 123 of the casing member 111 in accordance with the movement of the drive coupling 116 to the connecting position (refer to FIG. 14). The connecter 147 is retracted from the coupling insertion hole 123 of the casing member 111 in accordance with the movement of the drive coupling 116 to the disconnecting position (refer to FIG. 16).

The right end of the coil spring 117 comes into contact with the spring contact face 142 of the driving member 115. The left end of the coil spring 117 is inserted into a space between the inside tube 144 and outside tube 145 of the drive coupling 116 and comes into contact with the spring reception 146 of the drive coupling 116. Due to such a configuration, the coil spring 117 biases the drive coupling 116 to the connecting position.

The pressing member 120 is housed into the casing member 111 together with the driving member 115, drive coupling 116 and coil spring 117. The pressing member 120 includes a cylinder-formed engaging tube 151 and an arm 152 protruding forward from the outside of the engaging tube 151.

The engaging tube 151 is rotatably attached around the circumference of the outside tube 145 of the drive coupling 116 and its movement to the right side is restricted by the ring 150 of the drive coupling 116. Due to such a configuration, the pressing member 120 can be relatively rotated to the drive coupling 116 and be moved in the horizontal direction together with the drive coupling 116 in a body. The engaging tube 151 is inserted into the inside of the insertion tube 124 (refer to FIG. 13) provided on the left side plate 122 of the casing member 111. On the circumference of the engaging tube 151, engaging ribs 153 are formed below the arm 152 and at an opposite side to the arm 152, respectively. The engaging rib 153 is provided with pressing member side inclination 154. The pressing member side inclination 154 is inclined at a predetermined angle with the perpendicular plane S (refer to FIG. 13).

On the proximal end of the arm 152, a cylinder-formed first withdrawal boss 155 is protruded to the left side. On the distal end of the arm 152, a cylinder-formed second withdrawal boss 156 is protruded to the left side. A distance from a rotation center (refer to two-dot chain line A in FIG. 15) of the pressing member 120 to the first withdrawal boss 155 is shorter than another distance from the rotation center of the pressing member 120 to the second withdrawal boss 156. As shown in FIG. 14, the first withdrawal boss 155 penetrates through the first insertion hole 130 formed in the left side plate 122 of the casing member 111 and is protruded from the left side plate 122 in the left direction. The second withdrawal boss 156 penetrates through the second insertion hole 131 formed in the left side plate 122 of the casing member 111 and is protruded from the left side plate 122 in the left direction. One length of the protrusion of the second withdrawal boss 156 from the left side plate 122 is longer than another length of the protrusion of the first withdrawal boss 155 from the left side plate 122.

The first withdrawal boss 155 is adapted to move between upper and lower parts of the first insertion hole 130 in accordance with a turn of the pressing member 120 around the drive coupling 116. The second withdrawal boss 156 is adapted to move between upper and lower parts of the second insertion hole 131 in accordance with the turn of the pressing member 120 around the drive coupling 116. Hereinafter, one condition to position the first withdrawal boss 155 at the upper part of the first insertion hole 130 and to position the second withdrawal boss 156 at the upper part of the second insertion hole 131 (refer to FIG. 14) is called as "a pressure release condition" of the pressing member 120. Another condition to position the first withdrawal boss 155 at the lower part of the first insertion hole 130 and to position the second withdrawal boss 156 at the lower part of the second insertion hole 131 (refer to FIG. 16) is called as "a pressing condition" of the pressing member 120.

The locking member 121 is formed together with the development device main body 83 and casing member 111 in a body. On a left surface (an inside surface) of the locking member 121, a line-formed guiding gap 157 is formed along an installing direction of the toner container 6 to the installed part 89 of the development device 12 (in the embodiment, a direction inclining downward and backward; refer to arrow B in FIG. 14). On the rear bottom side of the guiding gap 157 (the recesses in the installing direction), a locking gap 158 is formed with a roughly circular profile in a side view.

Figure 17B:
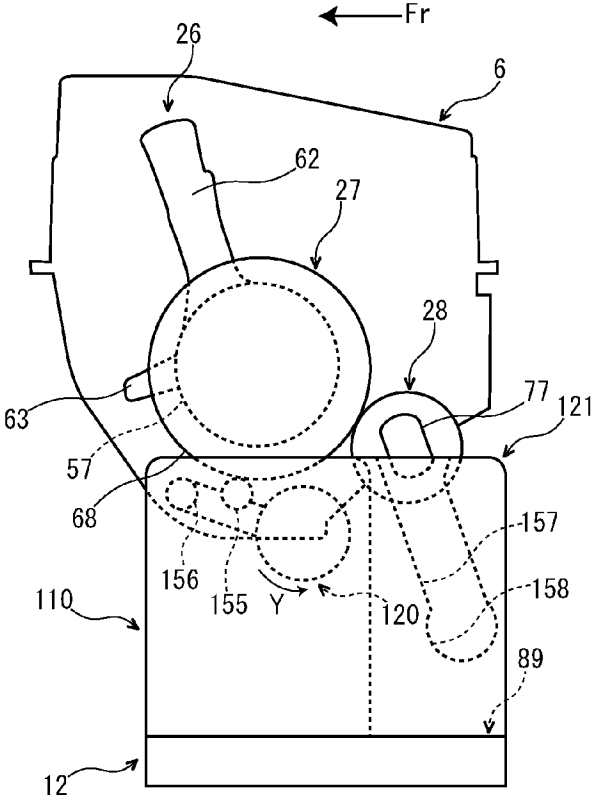
FIG. 17B is a schematic diagram schematically showing the printer in another situation, in which the toner container is finally taken down to the installed part of the development device and a transmission gear comes into contact with a first withdrawal boss, according to the embodiment of the present disclosure.
Figure 17A:
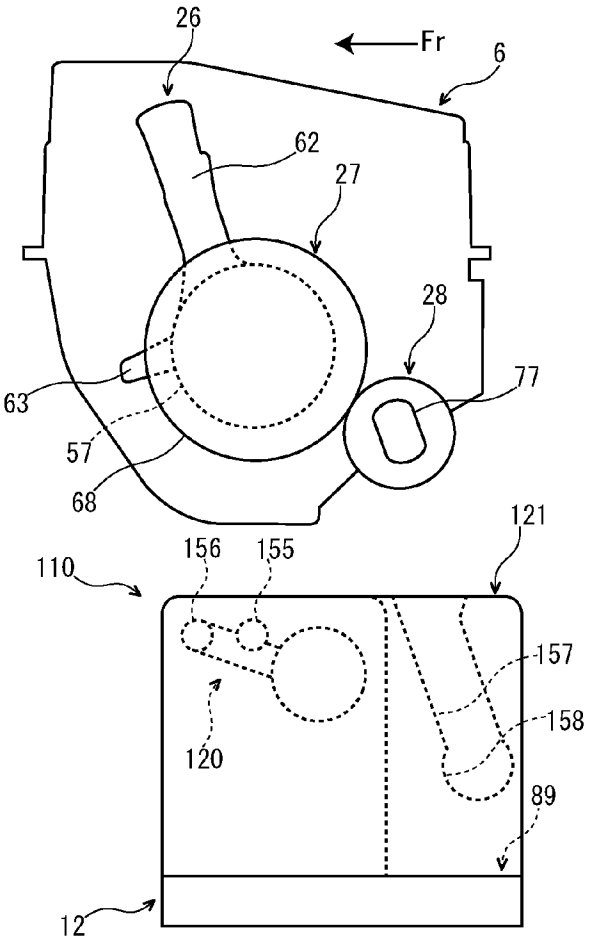
FIG. 17A is a schematic diagram schematically showing the printer in one situation, before the toner container is taken down to the installed part of the development device, according to the embodiment of the present disclosure.
Figure 18B:
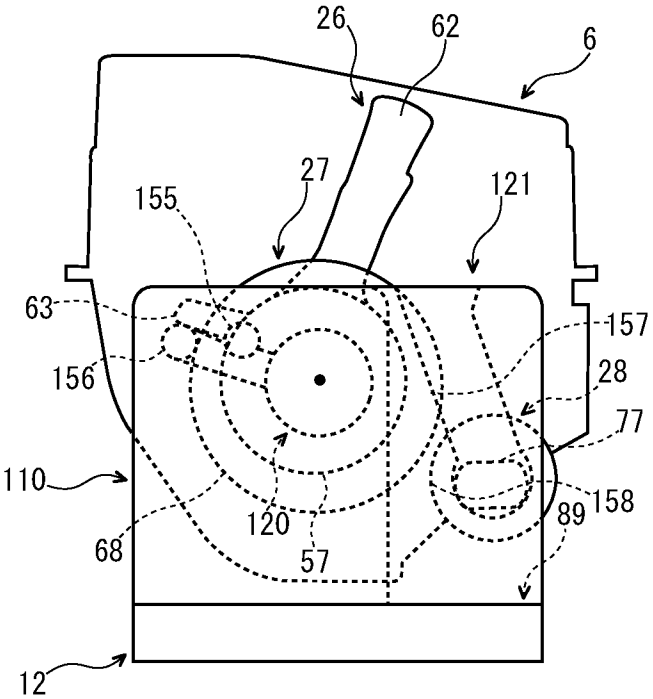
FIG. 18B is a schematic diagram schematically showing the printer in another situation, in which the toner container is finally installed into the installed part of the development device and the gripper of the lever is tilted backward, according to the embodiment of the present disclosure.
Figure 18A:
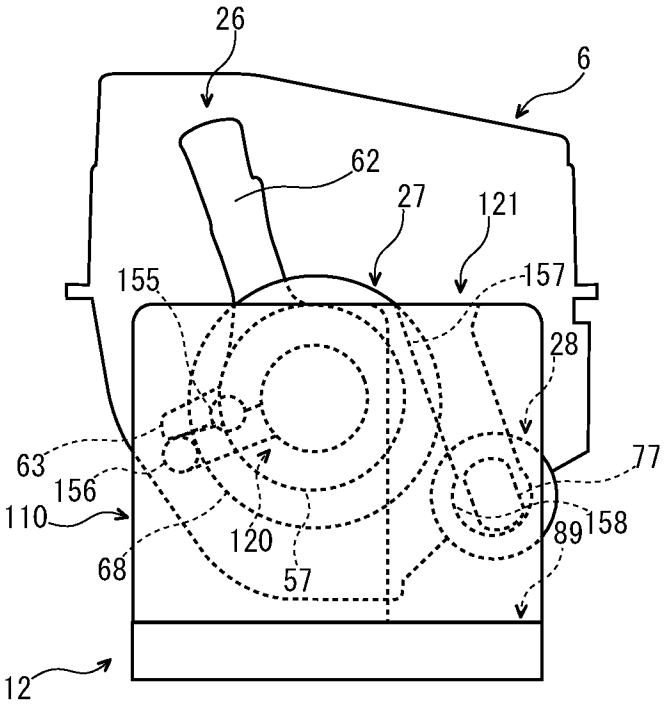
FIG. 18A is a schematic diagram schematically showing the printer in one situation, immediately after the toner container is installed into the installed part of the development device, according to the embodiment of the present disclosure.
Figure 19B:
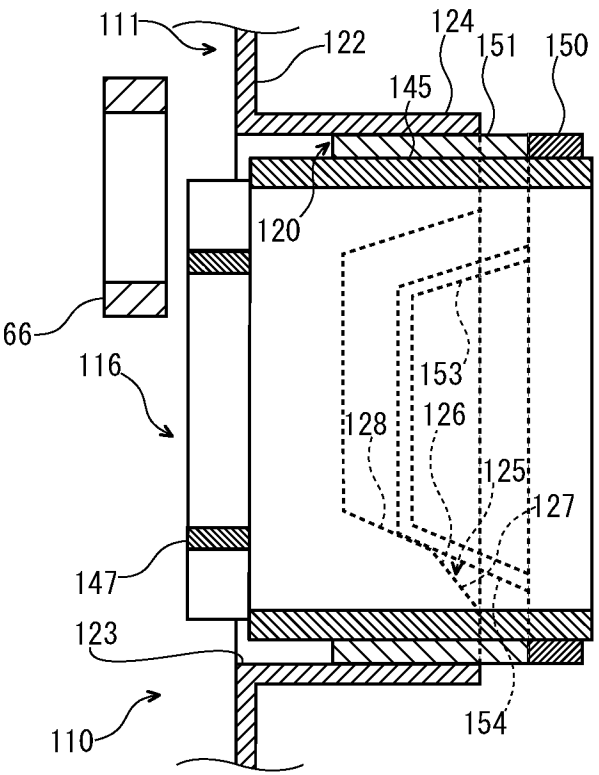
FIG. 19B is a sectional view showing the printer in another situation, in which the drive coupling is moving to its disconnecting position from the connecting position, according to the embodiment of the present disclosure.
Figure 19A:
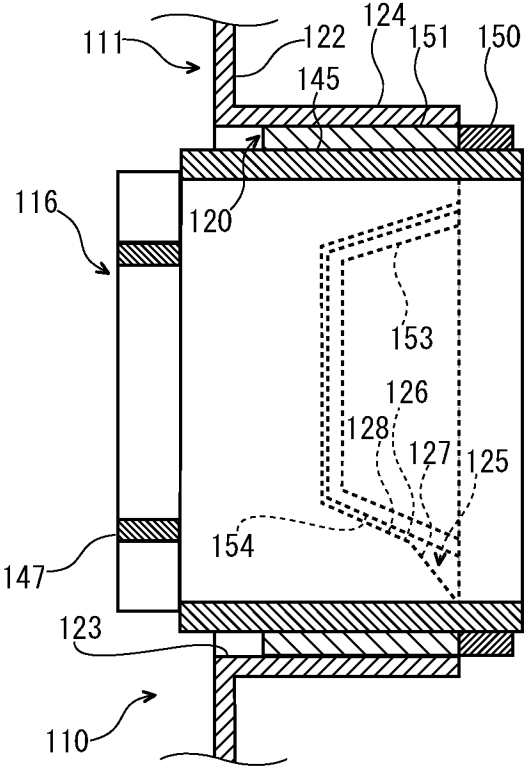
FIG. 19A is a sectional view showing the printer in one situation, in which the drive coupling is arranged at its connecting position, according to the embodiment of the present disclosure.
Figure 20B:
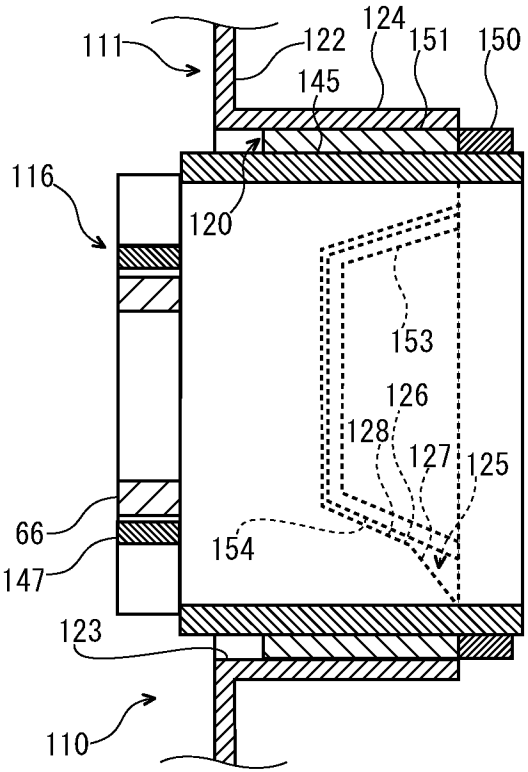
FIG. 20B is a sectional view showing the printer in another situation, in which the drive coupling is rearranged at its connecting position, according to the embodiment of the present disclosure.
Figure 20A:
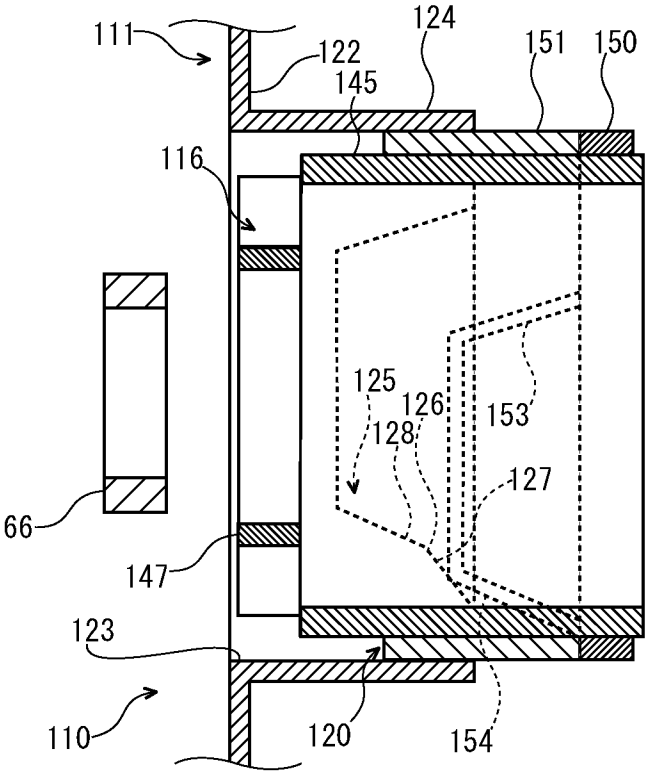
FIG. 20A is a sectional view showing the printer in one situation, in which the drive coupling has moved to its disconnecting position, according to the embodiment of the present disclosure.

In the aforementioned configuration, the operation of connecting the connecter 147 of the drive coupling 116 with the transmission coupling 66 will be described with reference to FIGS. 17-20. FIG. 17A is a schematic diagram schematically showing the printer in one situation, before the toner container is taken down to the installed part of the development device, according to the embodiment of the present disclosure. FIG. 17B is a schematic diagram schematically showing the printer in another situation, in which the toner container is finally taken down to the installed part of the development device and the transmission gear comes into contact with the first withdrawal boss, according to the embodiment of the present disclosure. FIG. 18A is a schematic diagram schematically showing the printer in one situation, immediately after the toner container is installed into the installed part of the development device, according to the embodiment of the present disclosure. FIG. 18B is a schematic diagram schematically showing the printer in another situation, in which the toner container is finally installed into the installed part of the development device and the gripper of the lever is tilted backward, according to the embodiment of the present disclosure. FIG. 19A is a sectional view showing the printer in one situation, in which the drive coupling is arranged at its connecting position, according to the embodiment of the present disclosure. FIG. 19B is a sectional view showing the printer in another situation, in which the drive coupling is moving to its disconnecting position from the connecting position, according to the embodiment of the present disclosure. FIG. 20A is a sectional view showing the printer in one situation, in which the drive coupling has moved to its disconnecting position, according to the embodiment of the present disclosure. FIG. 20B is a sectional view showing the printer in another situation, in which the drive coupling is rearranged at its connecting position, according to the embodiment of the present disclosure.

In FIGS. 19A, 19B, 20A and 20B, the driving member 115, the inside tube 144 and spring reception 146 of the drive coupling 116 and the coil spring 117 are omitted to simplify the figures.

In a situation before the toner container 6 is taken down to the installed part 89 of the development device 12, as shown in FIG. 17A, the pressing member 120 keeps the pressure release condition (refer to FIG. 14). As shown in FIG. 19A, the drive coupling 116 is kept in the connecting position.

From such a situation, when the toner container 6 is taken down to the installed part 89 of the development device 12, as shown in FIG. 17B, the lower part of the transmission gear 68 of the transmitting member 27 comes into contact with the first withdrawal boss 155 and the first withdrawal boss 155 is pressed in the lower direction. In accordance with the pressure, the pressing member 120 starts to turn in a Y direction (a counter clockwise direction in a right side view).

When the toner container 6 is further taken down, the transmission gear 68 of the transmitting member 27 comes into contact with the second withdrawal boss 156 and the second withdrawal boss 156 is pressed in the lower direction. In accordance with the pressure, the pressing member 120 further turns in a Y direction. When the toner container 6 is furthermore taken down to be installed into the installed part 89 of the development device 12, the pressing member 120 furthermore turns in a Y direction, and then, as shown in FIG. 18A, the pressing member 120 becomes the pressing condition (refer to FIG. 16). In addition, the second withdrawal boss 156 is stopped in an engaged state by the protruding piece 63 of the lever 26, and then, the turn of the pressing member 120 is restricted in a counter direction to the Y direction (a clockwise direction in a right side view, hereinafter, it is called as "a −Y direction").

When the pressing member 120 turns in the Y direction as mentioned above, as shown in FIG. 19B, the pressing member side inclination 154 comes into contact with the steeply inclined part 128 of the casing member side inclination 126 and slides along the steeply inclined part 128. Accordingly, the pressing member 120 moves in the right direction, and then, the engaging tube 151 of the pressuring member 120 presses the ring 150 of the drive coupling 116 in the right direction. The pressure works against a bias force of the coil spring 117 so that the drive coupling 116 moves from the connecting position in the right direction.

In accordance with the above-mentioned installation of the toner container 6 into the installed part 89 of the development device 12, the pressing member 120 turns further in the Y direction to become the pressing condition. Consequently, the pressing member side inclination 154 slides further along the steeply inclined part 128 of the casing member side inclination 126, and then, as shown in FIG. 20A, the left edge of the pressing member side inclination 154 comes into contact with the gently inclined part 127 of the casing member side inclination 126. Accordingly, the pressing member 120 moves in the further right direction, and then, the engaging tube 151 of the pressuring member 120 presses the ring 150 of the drive coupling 116 in the further right direction. The pressure works against a bias force of the coil spring 117 so that the drive coupling 116 moves in the further right direction to withdraw to the disconnecting position.

When the toner container 6 is taken down to the installed part 89 of the development device 12 as mentioned above, the transmission coupling 66 provided on the transmitting member 27 of the toner container 6 is taken down (as shown in FIGS. 19A and 19B). Subsequently, when the toner container 6 is installed into the installed part 89 of the development device 12, the transmission coupling 66 faces to the connecter 147 of the drive coupling 116 (refer to FIG. 20A).

When the installation of the toner container 6 to the installed part 89 of the development device 12 is thus completed, as shown in FIG. 18B, the worker, such as a user or a serviceman, may tilt the gripper 62 of the lever 26 backward. In such an operation of the lever 26, the lever 26 is turned in the −Y direction and the protruding piece 63 of the lever 26 is moved upward. Accordingly, the stop of the second withdrawal boss 156 by the protruding piece 63 is released to make the pressing member 120 possible to turn in the −Y direction. Therefore, by the bias force of the coil spring 117, the pressing member 120 is turned from the pressing condition to the pressure release condition.

In conjunction with this, as shown in FIG. 20B, by the bias force of the coil spring 117, the drive coupling 116 is moved from the disconnecting position to the connecting position. Accordingly, the connecter 147 of the drive coupling 116 is connected with the transmission coupling 66.

In order to release the connection of the connecter 147 of the drive coupling 116 with the transmission coupling 66, as shown in FIG. 18B, the gripper 62 of the lever 26 is tilted from the backward inclined state to the front side. Accordingly, as shown in FIG. 18A, the protruding piece 63 of the lever 26 presses the second withdrawal boss 156 of the pressing member 120 to make the pressing member 120 turned from the pressure release condition to the pressing condition.

Accordingly, as shown in FIG. 20B, the pressing member 120 presses the drive coupling 116 positioned in the connecting position in the right direction to make the drive coupling 116, as shown in FIG. 20A, withdrawn from the connecting position to the disconnecting position. Thus, the connection of the connecter 147 of the drive coupling 116 with the transmission coupling 66 is released.

In the embodiment, as described above, the coil spring 117 and pressing member 120 compose the movement mechanism 118 so that the movement mechanism 118 works in accordance with the operation of the lever 26 to move the drive coupling 116 from the disconnecting position to the connecting position. Therefore, after the installation of the toner container 6 to the installed part 89 is completed and the transmission coupling 66 is faced to the connecter 147 of the drive coupling 116, the connecter 147 of the drive coupling 116 can be connected with the transmission coupling 66. Thus, it is possible to securely connect the connecter 147 of the drive coupling 116 with the transmission coupling 66.

In addition, before the operation of the lever 26, the protruding piece 63 of the lever 26 makes the second withdrawal boss 156 stopped in an engaged state and the pressing member 120 keeps the pressing condition. On the other hand, when the lever 26 is operated, the stop of the second withdrawal boss 156 by the protruding piece 63 of the lever 26 is released and the pressing member 120 is turned from the pressing condition to the pressure release condition. Therefore, it is possible to certainly move the drive coupling 116 from the disconnecting position to the connecting position in accordance with the turn of the pressing member 120.

Further, accompanying to the installation of the toner container 6 into the installed part 89 of the development device 12, the transmission gear 68 of the transmitting member 27 presses the withdrawal boss 155 and 156 to make the pressing member 120 turned from the pressure release condition to the pressing condition. It is therefore possible to withdraw the drive coupling 116 from the connecting position to the disconnecting position by linking with the operation of installing the toner container 6 into the installed part 89 of the development device 12. It is then unnecessary to carry out separate operation for withdrawing the drive coupling 116, thereby decreasing a workload.

Furthermore, when the toner container 6 is installed into the installed part 89 of the development device 12, after a start of the pressure of the transmitting member 27 to the first withdrawal boss 155, the pressure of the transmitting member 27 to the second withdrawal boss 156 is started. Therefore, the first withdrawal boss 155 can brings forward the withdrawing timing of the drive coupling 116 and the second withdrawal boss 156 can securely•make the drive coupling 116 withdrawn to the disconnection position.

Moreover, when the pressing member 120 turns, the pressing member side inclination 154 slides along the casing member side inclinations 126, thereby moving the pressing member 120 along the movement direction of the drive coupling 116 (the horizontal direction in the embodiment). Due to such a configuration, the movement of the pressing member 120 and the pressure of the drive coupling 116 can be performed by a simple configuration.

Still further, the casing member side inclinations 126 is provided with several parts (the gently inclined part 127 and steeply inclined part 128) inclined at different angles with the perpendicular plane S from each other (refer to FIG. 13). By applying such a configuration, it is possible to optionally vary the moving rate of the pressing member 120 along the movement direction of the drive coupling 116 in accordance with the inclined angles of the gently inclined part 127 and steeply inclined part 128. Particularly, in the embodiment, because the steeply inclined part 128 is positioned at an upper stream from the gently inclined part 127 in the rotating direction (the rotating direction Y) of the pressing member 120 making the drive coupling 116 withdrawn, it is possible to increase an initial rate of withdrawing the drive coupling 116.

Next, in the image forming apparatus constructed as described above, the operation of supplying the toner from the toner container 6 to the photosensitive drum 10 will be described with reference to FIGS. 3-5, 11 and 12.

When the toner container 6 is installed into the installed part 89 of the development device 12 as mentioned above, the pressing protrusion 80 of the container side shutter 28 comes into contact with the development device side shutter 92 as shown in FIG. 4. At this moment, as shown in FIG. 11, the discharge port 35 of the container main body 22 is closed by the container side shutter 28. The replenishment port 88 of the development device main body 83 is also closed by the opening/closing part 94 of the development device side shutter 92.

In such a situation, when the gripper 62 of the lever 26 is tilted backward to make the container side shutter 28 turned as mentioned above, as shown in FIG. 3, the discharge aperture 70 of the container side shutter 28 moves just below the discharge port 35 of the container main body 22 and the communication port 38 of the sealing member 37. That is, the container side shutter 28 moves to a position to open the discharge port 35 of the container main body 22.

Accompanying to the turn of the container side shutter 28, as shown in FIGS. 4 and 5, the pressing protrusion 80 of the container side shutter 28 presses the development device side shutter 92 backward. In accordance with the pressure, the development device side shutter 92 turns backwards around the supporting pivot 93, and then, as shown in FIG. 3, the opening/closing part 94 of the development device side shutter 92 moves from the closing position to the opening position. That is, the development device side shutter 92 opens the replenishment port 88 of the development device main body 83.

In this situation, when the motor 113 (as shown in FIG. 12) of the driving mechanism 110 is driven, the rotation of the motor shaft 138 is transmitted to the transmitting member 27 via the worm gear 139, idle gear 114, driving member 115, drive coupling 116 and transmission coupling 66, and then, the transmitting member 27 is rotated. When the transmitting member 27 thus rotates, the stirring paddle 24 connected to the transmitting member 27 rotates, and then, the toner in the container main body 22 is stirred with being conveyed to the side of conveying screw 23. In addition, when the transmitting member 27 rotates as mentioned above, the rotation is transmitted to the rotating shaft 47 of conveying screw 23 via the transmission gear 68 and conveying gear 50, and then, the conveying screw 23 is rotated. Accompanying to this, the toner in the container main body 22 is discharged from the discharge port 35, and then, introduced into the development device main body 83 via the replenishment port 88. The toner introduced into the development device main body 83 is stirred by the stirring members 85, conveyed to the developing roller 86 and supplied from the developing roller 86 to the photosensitive drum 10.

In the embodiment, as described above, the container side shutter 28 configured to open/close the discharge port 35 in accordance with the operation of the lever 26 is attached onto the toner container 6. Therefore, it is possible to additionally utilize the lever 26 configured to open/close the container side shutter 28, thereby enhancing usefulness of the lever 26.

In addition, because the conveying screw 23 and stirring paddle 24 is installed into the toner container 6, it is possible to effectively discharge the toner in the toner container 6 to the outside of the discharge port 35.

Next, in the image forming apparatus constructed as described above, the operation of the locking piece 77 attached onto the container side shutter 28 will be described mainly with reference to FIGS. 17 and 18.

As shown in FIG. 17A, in a situation before taking down the toner container 6 to the installed part 89 of the development device 12, the locking piece 77 and locking member 121 are separated from each other. In such a situation, when the toner container 6 is taken down into the installed part 89 of the development device 12, as shown in FIG. 17B, the locking piece 77 is engaged with the guiding gap 157 of the locking member 121. Subsequently, when the toner container 6 is installed into the installed part 89 of the development device 12, as shown in FIG. 18A, the locking piece 77 passes through the guiding gap 157 and is engaged with the locking gap 158.

In this situation, when the gripper 62 of the lever 26 is tilted backward as mentioned above to make the lever 26 turned, the container side shutter 28 connected with the lever 26 is turned on the container main body 22 (refer to FIGS. 4 and 5). By the turn of the container side shutter 28, as shown in FIG. 18B, the phase of the locking piece 77 on the locking gap 158 is varied and the release of the engagement of the locking piece 77 with the locking gap 158 is restrained.

Thus, the toner container 6 and locking member 121 are made impossible to separate from each other, thereby preventing from shifting positions of the toner container 6 and driving mechanism 110. Therefore, it is possible to further securely connect the drive coupling 116 with the transmission coupling 66.

Although the embodiment was described in a case where the lever 26 and container side shutter 28 are formed in separate bodies, the lever 26 and container side shutter 28 may be formed in a body as another embodiment.

Although both the container side shutter 28 and development device side shutter 92 are rotatable shutters in the embodiment, as a still another embodiment, one of the container side shutter 28 and development device side shutter 92 may be a linear-slidable shutter. Alternatively, both the container side shutter 28 and development device side shutter 92 may be linear-slidable shutters.

Although ideas of the disclosure are applied into the toner container 6 in the embodiment, as a further embodiment, the ideas of the disclosure may be applied into another toner case (so-called "an intermediate hopper") interposed between the toner container 6 and development device 12.

Although the embodiment was described in a case where ideas of the disclosure are applied into the printer 1, as a furthermore embodiment, the ideas of the disclosure may be applied into another image forming apparatus except the printer 1, such as a copying machine, a facsimile or a multi-function machine.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A toner case comprising:

a container main body provided with a discharge port configured to discharge a toner;

a rotating member installed into the container main body and configured to discharge the toner in the container main body from the discharge port; and a transmission coupling connected with the rotating member and detachably connected with a drive coupling, wherein the toner case is detachably installed into an installed part, and the toner case is further provided with a lever configured to move the drive coupling, in a state of installing the toner case into the installed part, from a disconnecting position to a connecting position with the transmission coupling.

2. An image forming apparatus comprising:

a toner case including a container main body provided with a discharge port configured to discharge a toner, a rotating member installed into the container main body, and a transmission coupling connected with the rotating member;

a driving mechanism including a drive coupling detachably connected with the transmission coupling and a drive unit configured to rotate the drive coupling; and an installed part into which the toner case is detachably installed, wherein the toner case has a lever supported onto the container main body, and the driving mechanism has a movement mechanism configured to work in accordance with the operation of the lever, in a state of installing the toner case into the installed part, to move the drive coupling from a disconnecting position to a connecting position with the transmission coupling.

3. The image forming apparatus according to claim 1, wherein the movement mechanism includes:

a biasing member configured to bias the drive coupling to the connecting position; and a pressing member being rotatably attached onto the drive coupling, the pressing member being adapted to turn between a pressing condition, where the drive coupling is pressed to the disconnecting position against a bias force of the biasing member, and a pressure release condition, where the pressure is released to make the drive coupling moved from the disconnecting position to the connecting position by the bias force of the biasing member, and before the operation of the lever, the lever stops the pressing member in an engaged state so that the pressing member keeps the pressing condition, whereas when the lever is operated, the stop of the pressing member by the lever is released so that the pressing member is turned from the pressing condition to the pressure release condition.

4. The image forming apparatus according to claim 3, wherein the toner case is provided with a transmission member including the transmission coupling, the pressing member is provided with a withdrawal bosses, and when the toner case is installed into the installed part, the transmission member presses the withdrawal bosses so that the pressing member is turned from the pressure release condition to the pressing condition.

5. The image forming apparatus according to claim 4, wherein the withdrawal bosses are located at several positions where are different in distance from the rotation center of the pressing member, and when the toner case is installed into the installed part, after a start of the pressure of the transmitting member to a first withdrawal boss, the pressure of the transmitting member to a second withdrawal boss is started.

6. The image forming apparatus according to claim 5, wherein the first withdrawal boss is positioned at a shorter distance to the rotation center of the pressing member than the second withdrawal boss.

7. The image forming apparatus according to claim 3, wherein the driving mechanism has a casing member configured to install the movement mechanism, the casing member has casing member side inclination formed so as to incline from a perpendicular plane to the movement direction of the drive coupling, and when the pressing member is turned, the pressing member slides along the casing member side inclination so that the pressing member is moved along the movement direction of the drive coupling.

8. The image forming apparatus according to claim 7, wherein the casing member side inclination includes several parts respectively inclined at different angles with the perpendicular plane to the movement direction of the drive coupling.

9. The image forming apparatus according to claim 8, wherein the casing member side inclination includes:

a gently inclined part inclined at a predetermined angle with the perpendicular plane to the movement direction of the drive coupling; and a steeply inclined part inclined at a steeper angle than the gently inclined part with the perpendicular plane to the movement direction of the drive coupling, and the steeply inclined part is positioned at an upper stream from the gently inclined part in a rotating direction of the pressing member making the drive coupling withdrawn.

10. The image forming apparatus according to claim 2, wherein the toner case is provided with a shutter connected with the lever configured to open/close the discharge port in accordance with the operation of the lever.

11. The image forming apparatus according to claim 10, wherein the shutter is provided with a locking piece with a non-circular section and rotatably attached onto the container main body, the driving mechanism includes a locking member, the locking member having a guiding gap formed along a direction of installing the toner container into the installed part and a locking gap formed at the recesses of the guiding gap in the installing direction, when the toner container is installed into the installed part, the locking piece passes through the guiding gap and is engaged with the locking gap, and when the lever is operated in a state of installing the toner container into the installed part, the shutter is turned so that the phase of the locking piece on the locking gap is varied and the release of the engagement of the locking piece on the locking gap is restrained.

12. The image forming apparatus according to claim 10, wherein the lever is rotatably supported onto the container main body and includes a lever side gear, the shutter includes a shutter side gear meshing with the lever side gear, and in accordance with the turn of the lever, the shutter turns in the opposite direction to the lever.

13. The image forming apparatus according to claim 2, wherein the rotating member includes:

a stirring paddle configured to stir the toner contained in the toner case; and a conveying screw configured to discharge the toner stirred by the stirring paddle from the discharge port.

14. The image forming apparatus according to claim 2, wherein the driving mechanism includes a drive member rotating in accordance with the drive of the drive unit, and the drive coupling is adapted to rotate together with the drive member in a body and to move in a given direction from the drive member.

15. The image forming apparatus according to claim 4, wherein the biasing member is a coil spring.

16. A toner case comprising:

a container main body provided with a discharge port configured to discharge a toner;

a rotating member installed into the container main body; and a transmission coupling connected with the rotating member, the toner case being installed in an image forming apparatus which includes:

a driving mechanism having a drive coupling detachably connected with the transmission coupling and a drive unit configured to rotate the drive coupling; and an installed part into which the toner case is detachably installed, wherein the toner case has a lever supported onto the container main body, and the driving mechanism has a movement mechanism configured to work in accordance with the operation of the lever, in a state of installing the toner case into the installed part, to move the drive coupling from a disconnecting position to a connecting position with the transmission coupling.

17. The toner case according to claim 16, further comprising a shutter connected with the lever configured to open/close the discharge port in accordance with the operation of the lever.

18. The toner case according to claim 17, wherein the shutter is provided with a locking piece with a non-circular section and rotatably attached onto the container main body, the driving mechanism includes a locking member, the locking member having a guiding gap formed along a direction of installing the toner container into the installed part and a locking gap formed at the recesses of the guiding gap in the installing direction, when the toner container is installed into the installed part, the locking piece passes through the guiding gap and is engaged with the locking gap, and when the lever is operated in a state of installing the toner container into the installed part, the shutter is turned so that the phase of the locking piece on the locking gap is varied and the release of the engagement of the locking piece on the locking gap is restrained.

* * * * *